United States Patent [19]

Nishibayashi et al.

[11] 4,267,246

[45] May 12, 1981

[54] PRESSURE OR HEATED ROLLER ELECTROPHOTO IMAGE FIXING USES HALOGEN OR NITRILE CONTAINING POLYMER DISPERSED WITHIN RESIN BINDER AS OFFSET PREVENT TONER

[75] Inventors: Katsumi Nishibayashi, Hirakata; Yoshimi Amagai, Katano; Norio Hikake, Kyoto; Toshihiro Kouchi, Hirakata; Tatsuo Aizawa, Osaka, all of Japan

[73] Assignee: Mita Industrial Company Limited, Katano, Japan

[21] Appl. No.: 123,463

[22] Filed: Feb. 21, 1980

Related U.S. Application Data

[62] Division of Ser. No. 906,650, Jun. 5, 1978.

[30] Foreign Application Priority Data

May 17, 1977 [JP] Japan ..... 52-55970
Jun. 14, 1977 [JP] Japan ..... 52-69444

[51] Int. Cl.[3] ..... G03G 11/00; G03G 13/16

[52] U.S. Cl. ..... 430/98; 430/99; 430/121; 430/126; 430/111

[58] Field of Search ..... 430/121, 98, 99, 102, 430/126, 111

[56] References Cited

U.S. PATENT DOCUMENTS 3,764,538 10/1973 Shelffo ..... 430/904 X

FOREIGN PATENT DOCUMENTS 52-640 4/1977 Japan ..... 430/99

OTHER PUBLICATIONS

Xerox Disc. J., vol. 3, #3, May/Jun. 1978, pp. 155–157.

*Primary Examiner*—John D. Welsh
*Attorney, Agent, or Firm*—Sherman & Shalloway

[57] ABSTRACT

A developer for electrostatic images comprising a binder medium and a pigment dispersed in the binder medium is disclosed. This binder medium comprises (A) a thermoplastic or rubbery polymer containing a member selected from the group consisting of a halogen atom and a nitrile group at a concentration of at least 100 milliequivalents per 100 g of the polymer and (B) a binder having a melting temperature lower than that of the polymer (A) at an (A)/(B) mixing weight ratio of from 1/20 to 1/1. The halogen- or nitrile-containing polymer (A) is present in the form of fine particles dispersed in the continuous phase of the binder (B). This developer has good flowability and charge characteristics at the developing step and shows an excellent offset-preventing effect at the fixing step.

14 Claims, No Drawings

PRESSURE OR HEATED ROLLER ELECTROPHOTO IMAGE FIXING USES HALOGEN OR NITRILE CONTAINING POLYMER DISPERSED WITHIN RESIN BINDER AS OFFSET PREVENT TONER

This is a division of application Ser. No. 906,650, filed June 5, 1978.

BACKGROUND OF THE INVENTION (1) Field of the Invention

This invention relates to a developer for electrostatic images and a process for the preparation thereof. More particularly, the invention relates to a developer for electrostatic images which has a preferred combination of the flowability and charged characteristics at the developing step with the offset-preventing effect at the fixing step.

(2) Description of the Prior Arts

As one of the methods for developing electrostatic latent images formed by the electrostatic photographic process, there is broadly adopted a so-called magnetic brush method. According to this magnetic brush method, a so-called two-component type developer comprising a blend of a powdery magnetic carrier such as iron powder and toner particles formed by dispersing a pigment in a binder medium and a so-called one-component type developer consisting of electrically conductive magnetic particles formed by dispersing a fine powder of a magnetic material such as triiron tetroxide, together with other pigment according to need, into a binder resin and, if desired, subjecting the surfaces of the resulting particles to a conducting treatment are ordinarily used as the developer. The toner particles or the particles of the one-component type developer applied to an electrostatic image are fixed by appropriate heating means directly or after transfer to a photosensitive sheet for the electrostatic photography.

From the viewpoints of the heat efficiency, the prevention of occurrence of fires and speed of the fixing operation, a heat-press fixing method using a roller is preferred for fixation of developer particles. According to this method, since the surface of the fixing roller is caused to contact with an image of the developer particles under heating and compression, some developer particles are transferred to the surface of the fixing roller to adhere thereto. Namely, a so-called offset phenomenon is caused to occur. It is known that such developer particles adhering to the surface of the fixing roller are transferred again to a sheet on which the developer image is fixed, contaminating a photosensitive plate or transfer sheet.

As means for preventing occurrence of such undesirable offset phenomenon, there has been adopted a method in which a fixing roller having a surface portion formed of a material excellent in the parting property or contamination resistance, such as fluorine resin, is used and a thin layer of an offset-preventing liquid such as silicone oil is formed on the surface of the fixing roller. However, if this method is adopted, the structure of the fixing apparatus is complicated, and it is difficult to feed the offset-preventing liquid in precise coincidence with the copying or printing operation.

As means overcoming these disadvantages, there has been proposed a method in which a substance acting as a parting agent is incorporated in developer particles, and this substance is released on the surfaces of the developer particles in the form of a liquid at the roller-fixing step to thereby prevent occurrence of the offset phenomenon. For example, Japanese Patent Publication No. 3304/77 discloses a toner for developing electrostatic images, which comprises a coloring agent, a styrene type resin and a low-molecular-weight polymer of propylene. The method using such toner is advantageous in that the fixing operation can be performed at a high efficiency without occurrence of the offset phenomenon by using a fixing roller to the surface of which an offset-preventing liquid need not be supplied. However, this toner is still insufficient in the properties required at the developing step.

In a toner of this type, it is indispensable that the substance acting as a parting agent should be released in the form of a liquid on the surfaces of the toner particles at the fixing step. Therefore, it is necessary that a relatively large amount of the parting substance should be contained in the toner particles. When the parting substance is included in the toner particles in a large amount, the flowability and charge characteristics of the toner particles are drastically lowered. Most of substances that can be used as a parting agent are soft under normal conditions. Toner particles containing such soft substance in the surface portion have a tendency to agglomerate and they have not a flowability sufficient to coat them uniformly on a roller (sleeve) for formation of magnetic brushes. Accordingly, masses of agglomerated toner particles are formed on the surface of the sleeve and contamination of the background is caused by falling of such masses. Further, blurring of an image is readily caused by nonuniform adhesion of the toner particles to the surface of the sleeve.

In the commercial electrostatic photography or printing, electrostatic images formed are generally negatively charged. Accordingly, toner particles having a positive charge polarity are ordinarily used. Most of the above-mentioned parting substances incorporated in toner particles in relatively large amounts have bad influences on the above charge polarity. For example, the above-mentioned polypropylene was found to reduce the above charge characteristic of being positively charged in toner particles, at experiments made by us.

The above disadvantage observed when a relatively large quantity of the parting substance is incorporated in toner particles is very prominent in an electrostatic photographic process of the type in which a toner image formed on an electrostatic photographic photosensitive plate is transferred onto a transfer sheet and the photosensitive plate is used repeatedly. More specifically, the parting substance present on the surfaces of the toner particles is transferred onto the surface of the photosensitive plate and gradually accumulated thereon to form an electrically insulating layer on the surface of the photosensitive plate. Accordingly, if such toner is used in this electrostatic photographic process, even when the photosensitive plate is used repeatedly only several times, foggoing of prints or electric breakdown of the photosensitive plate is caused by residual charges on the photosensitive plate, resulting in extreme shortening of the life of the photosensitive plate. The parting substance contained in toner particles is transferred also to a magnetic carrier such as iron powder and accumulated thereon, causing the degradation of the carrier.

BRIEF SUMMARY OF THE INVENTION

We found that the foregoing defects can be eliminated according to a technical concept quite contrary to the conventional concept of incorporating a parting substance which is released in the form of a liquid at the fixing step, into a developer composition comprising a pigment and a binder. More specifically, it was found that occurrence of the offset phenomenon can be effectively prevented and the above defects involved in the conventional developers can be overcome by a developer formed by incorporating in a developer composition of the above-mentioned type (A) a specific polymer containing a halogen atom or a nitrile group (—CN) and (B) a binder having a melting temperature lower than that of the halogen- or nitrile-containing polymer (A) to form a microstructure in which particles of the polymer (A) are dispersed in a continuous phase of the polymer (B). In the developer of this invention, the halogen- or nitrile-containing polymer (A) present in the form of dispersed particles is hardly liquefied or molten as compared with the binder (B) and the polymer (A) is quite different from the conventional parting substance in respect of physical properties and functions. It has not been known that the halogen- or nitrile-containing polymer dispersed in the above-mentioned state has an effect of preventing occurrence of the offset phenomenon. Further, by virtue of the fact that the halogen- or nitrile-containing polymer (A) is a macromolecular compound quite different from the conventional parting substances, the developer of this invention has an excellent flowability and a reduced tendency to agglomerate. Further, the developer of this invention is advantageous in that a magnetic carrier or an electrophotographic photosensitive plate that is used repeatedly is hardly contaminated and the charge characteristics of the developer of this invention are very excellent.

More specifically, in accordance with this invention, there is provided a developer for electrostatic images having an excellent offset resistance, which comprises a binder medium and a pigment dispersed therein, wherein the binder medium comprising (A) a thermoplastic or rubbery polymer containing a halogen atom or nitrile group at a concentration of at least 100 milliequivalents (milligram atoms or millimoles) per 100 g of the polymer, preferably 200 to 1600 milliequivalents per 100 g of the polymer, and (B) a binder having a melting temperature lower than that of the halogen- or nitrile-containing polymer (A) at an (A)/(B) mixing weight ratio of from 1/20 to 1/1, and said halogen- or nitrile-containing polymer (A) is present in the form of fine particles dispersed in the continuous phase of the binder (A).

This invention can be broadly applied to not only a two-component type developer comprising toner particles to be used in combination with a carrier consisting of a fine powder of a magnetic material such as iron powder but also a one-component type developer comprising particles in which a fine powder of a magnetic material such as triiron tetroxide has been incorporated in advance. In the instant specification and appended claims, the term "developer" indicates a concept including a two-component type developer and a one-component type developer, and the term "toner particles" is used to indicate toner particles to be used in combination with a carrier, in contrast with the one-component type developer.

This invention will now be described in detail.

DETAILED DESCRIPTION OF THE PREFERRED EMBODIMENTS

One of important features of this invention resides in the finding that when a specific halogen- or nitrile-containing polymer is combined with a specific binder in a composition of a dry-type developer and incorporated in a specific dispersion state, occurrence of the offset phenomenon is prevented at the fixing step according to a mechanism quite different from the mechanism of the conventional technique using a parting substance which is liquefied at the fixing step, and by virtue of this pecular mechanism, the flowability and charge characteristics of developer particles can be remarkably improved over the known offset-preventive toners and contamination of a carrier or photosensitive plate can be markedly reduced.

As the halogen- or nitrile-containing polymer, there can be used any of thermoplastic and rubbery polymers containing at least one member selected from the group consisting of a halogen atom and a nitrile group at a concentration of at least 100 milliequivalents, preferably at least 200 milliequivalents, especially preferably at least 500 milliequivalents, per 100 g of the polymer. The polymer may contain both the halogen atom and nitrile group or either of the halogen atom and nitrile group. When the concentration of the halogen atom or nitrile group is lower than 100 milliequivalents per 100 g of the polymer, the offset-preventing effect attainable is not satisfactory. It is preferred that the concentration of the halogen atom or nitrile group be not higher than 1600 milliequivalents, especially not higher than 1100 milliequivalents, per 100 g of the polymer. When the halogen or nitrile concentration is too high, it is difficult to obtain a developer having a dispersion state defined in this invention and no satisfactory offset-preventing effect can be attained. In case of the halogen-containing polymer, the halogen concentration may be elevated to about 400 milliequivalents per 100 g of the polymer, the above-mentioned reduction of the offset-preventing effect is similarly observed when the halogen concentration is too high.

As the halogen-containing polymer (A), there can be mentioned polymers containing a halogen atom such as chlorine, fluorine or iodine, especially chlorine. Suitable examples of the halogen-containing polymer (A) are homopolymers and copolymers of halogen-containing ethylenically unsaturated monomers represented by the following formula:

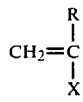

(1)

wherein X stands for a halogen atom, especially a chlorine atom, and R stands for a hydrogen or halogen atom, such as vinyl chloride, vinylidene chloride, vinyl fluoride, vinylidene fluoride and vinyl bromide, or other halogen-containing ethylenically unsaturated monomers such as tetrafluoroethylene, chlorotrifluoroethylene, tetrachloroethylene and hexafluoropropylene, and copolymers of the foregoing monomers with other ethylenically unsaturated monomers; homopolymers and copolymers of halogen-containing diolefin type monomers such as 2-chlorobutadiene (chloroprene), and copolymers of these monomers with other ethylenically unsaturated monomers; and halogenation products of hydrocarbon polymers and halogen-containing hydrocarbon polymers. Among these polymers, those satisfying the above-mentioned requirement of this invention are used as the polymer (A) in this invention.

Specific examples of the halogen-containing polymer that can be used in this invention include polyvinyl chloride, vinyl chloride copolymers, vinylidene chloride resins, vinyl chloride/vinylidene chloride copolymers, polyvinyl fluoride, polytetrafluoroethylene, polychlorotrifluoroethylene, chlorinated polyethylene, chlorinated polypropylene, chlorinated polyvinyl chloride, chloroprene polymers, chlorinated polysiobutylene and tetrafluoroethylene/hexafluoropropylene copolymers.

A homopolymer of an ethylenically unsaturated nitrile is not suitable as the nitrile-containing polymer (A) in this invention. In this invention, copolymers of (a) an ethylenically unsaturated nitrile monomer with at least one monomer selected from (b) other ethylenically unsaturated monomer and (c) a diolefin type monomer or blends of these copolymers are advantageously used.

As the ethylenically unsaturated monomer (a), there can be used at least one member selected from the group consisting of nitriles represented by the following general formula:

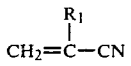

(2)

wherein $R_1$ stands for a hydrogen atom, an alkyl group having up to 4 carbon atoms (hereinafter referred to as "lower alkyl group") or a halogen atom,
such as acrylonitrile, α-chloroacrylonitrile, α-fluoroacrylonitrile and methacrylonitrile. Among these nitriles, acrylonitrile, methacrylonitrile and mixtures thereof are especially preferred.

The above-mentioned halogen-containing monoethylenically unsaturated monomer or diolefin type unsaturated monomer and the above-mentioned unsaturated nitrile can be used not only in the form of a copolymer of these monomers but also in the form of a copolymer with other comonomer selected from diolefin type unsaturated monomers, monovinyl aromatic monomers, mono-olefinic monomers, acrylic monomers, vinyl ester monomers and vinyl ether monomers.

As the diolefin type comonomer, there can be mentioned, for example, diolefins represented by the following formula:

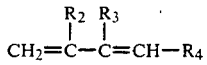

(3)

wherein $R_2$, $R_3$ and $R_4$, which may be the same or different, stand for a hydrogen atom or a lower alkyl group,
such as butadiene and isoprene.

As the mono-olefinic comonomer, there can be mentioned, for example, mono-olefins represented by the following formula:

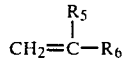

(4)

wherein $R_5$ and $R_6$, which may be the same or different, stand for a hydrogen atom or a lower alkyl group, such as ethylene, propylene, isobutylene, butene-1, pentene-1 and 4-methylpentene-1.

Suitable examples of other comonomers, there can be mentioned monovinyl aromatic hydrocarbons represented by the following formula:

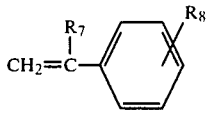

(5)

wherein $R_7$ stands for a hydrogen atom, a lower alkyl group or a halogen atom, and $R_8$ stands for a hydrogen atom, a lower alkyl group, a halogen atom, an alkoxy group, an amino group, a nitro group or a carboxyl group,
such as styrene, α-methylstyrene, vinyltoluene, α-chlorostyrene, o-chlorostyrene, m-chlorostyrene, p-chlorostyrene p-ethylstyrene and mixtures of two or more of them; acrylic monomers represented by the following formula:

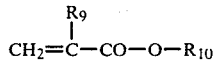

(6)

wherein $R_9$ stands for a hydrogen atom or a lower alkyl group, and $R_{10}$ stands for a hydrogen atom, a hydrocarbon group having up to 12 carbon atoms, a hydroxyalkyl group or an aminoalkyl group,
such as acrylic acid, methacrylic acid, methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, ethyl β-hydroxyacrylate, propyl γ-hydroxyacrylate, butyl δ-hydroxyacrylate, ethyl β-hydroxymethacrylate, propyl γ-aminoacrylate and propyl γ-N,N-diethylaminoacrylate; other ethylenically unsaturated carboxylic acids such as maleic anhydride, fumaric acid, itaconic acid and crotonic acid; vinyl esters represented by the following formula:

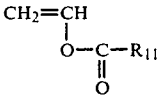

(7)

wherein $R_{11}$ stands for a hydrogen atom or a lower alkyl group,
such as vinyl formate, vinyl acetate and vinyl propionate; and vinyl ethers represented by the following formula:

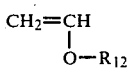

(8)

wherein $R_{12}$ stands for a monovalent hydrocarbon group having up to 12 carbon atoms,
such as vinylmethyl ether, vinylethyl ether, vinyl-n-butyl ether, vinylphenyl ether and vinylcyclohexyl ether.

In addition, there can be used amides of ethylenically unsaturated carboxylic acids such as acrylamide and methacrylamide, N-vinyl compounds such as N-vinylpyrrolidone, N-vinylindole and N-vinylcarbazole, and vinyl ketones such as vinylmethyl ketone and vinylhexyl ketone.

From the viewpoints of the offset-preventing effect, the moldability of the developer composition to particles and the stability of the properties of the resulting developer particles, it is preferred to use as the halogen-containing polymer (A) copolymers of vinyl chloride with other monomers as mentioned above and modification (saponification or acetalization) products of these copolymers, especially vinyl chloride/vinyl acetate copolymers, partially and completely saponified vinyl chloride/vinyl acetate copolymers, saponified and acetalized vinyl chloride/vinyl acetate copolymers, vinyl chloride/vinyl acetate/maleic anhydride copolymers, vinyl chloride/vinyl acetate/acrylic acid ester copolymers, vinyl chloride/acrylonitrile copolymers, vinyl chloride/acrylic acid ester copolymers and vinyl chloride/acrylic acid ester/maleic acid copolymers.

These halogen-containing polymers (A) may be used singly, or mixtures of two or more of them can be used. In order to improve the thermal stability of these polymers (A), it is possible to incorporate with the polymers (A) known stabilizers such as inorganic acid salts, organic acid salts and metal-containing organic compounds of calcium, magnesium, barium, zinc, cadmium, lead and tin, in amounts of 0.01 to 10% by weight based on the polymer.

The molecular weight of the halogen-containing polymer (A) is not particularly critical so far as the softening point is not higher than 180° C. and the polymer has a film-forming property. For example, in case of vinyl chloride resins such as polyvinyl chloride and vinyl chloride-vinyl acetate copolymers, commercially available products having an average polymerization degree $(\overline{P})$ of 200 to 4000 are preferably used. Of course, also vinyl chloride resins having a lower or higher polymerization degree can be used so far as the foregoing requirements are satisfied.

In general, it is preferred that the halogen-containing polymer (A) be characterized by a softening point of 60° to 170° C. and a melting temperature of 140° to 180° C. If such halogen-containing copolymer (A) is employed, it can be dispersed in the binder (B) described below and the desired dispersion state can easily be attained.

So far as the ethylenically unsaturated nitrile monomer (a) is present in the nitrile-containing polymer (A) in such an amount as will provide the above-mentioned nitrile concentration, the type of polymerization of the nitrile monomer (a) is not particularly critical. Namely, the ethylenically unsaturated nitrile monomer (a) and comonomers as mentioned above may be included in the random or block form in the polymer chain. Further, a polymer blend comprising at least two nitrile-containing polymers (A) may be used in this invention.

So far as the nitrile-containing polymer (A) has a film-forming property, the molecular weight of the nitrile-containing polymer (A) is not particularly critical. In general, however, it is preferred that the molecular weight of the nitrile-containing polymer be in the range of from 10,000 to 500,000.

Suitable examples of the nitrile-containing polymers (A) include acrylonitrile/butadiene copolymers, acrylonitrile/styrene copolymers, acrylonitrile/-butadiene/styrene copolymers and acrylonitrile/-butadiene/styrene/methyl methacrylate copolymers. These copolymers are easily commercially available under such tradenames as AS resins, ABS resins, nitrile rubbers and high-nitrile resins.

In general, it is preferred that the nitrile-containing polymer (A) be characterized by a softening point of 80° to 170° C. and a melting temperature of 130° to 190° C. When such nitrile-containing polymer (A) is used, if it is combined with the binder (B) described below, a desired dispersion state can easily be attained.

The binder (B) that is used in combination with the above-mentioned halogen- or nitrile-containing polymer (A) should have a melting temperature lower than that of the halogen- or nitrile-containing polymer (A); otherwise, the intended offset-preventing effect cannot be attained. More specifically, when a binder having a melting temperature higher than that of the halogen- or nitrile-containing polymer (A) is used, the dispersion state specified in this invention can hardly be attained and no satisfactory offset-preventing effect can be attained. Among known natural, semi-synthetic and synthetic resins, rubbers and waxes, those meeting the above requirement are chosen and used as the binder (B) in this invention.

As the resin, there can be used thermoplastic resins and uncured or preliminarily condensed thermosetting resins. As suitable examples, there can be mentioned, in the order of importance, vinyl aromatic resins, acrylic resins, polyvinyl acetal resins, polyester resins, epoxy resins, phenolic resins, petroleum resins and olefin resins, though binders that can be used in this invention are not limited to these resins.

As the vinyl aromatic resin, there are used homopolymers and copolymers of monomers represented by the above general formula (5) and copolymers of these monomers with other ethylenically unsaturated monomers.

As the monomer copolymerizable with the vinyl aromatic monomer of the formula (5), there can be mentioned vinyl esters such as vinyl acetate, vinyl formate and vinyl propionate, ethylenically unsaturated carboxylic acids such as acrylic acid, methacrylic acid, maleic anhydride, fumaric acid, crotonic acid and itaconic acid, esters of ethylenically unsaturated carboxylic acids such as ethyl acrylate, methyl methacrylate, 2-ethylhexyl acrylate and 3-hydroxyethyl acrylate, amides of ethylenically unsaturated carboxylic acids such as acrylamide and methacrylamide, N-vinyl compounds such as N-vinylpyrrolidone, N-vinylindole and N-vinylcarbazole, vinyl ethers such as vinylmethyl ether and vinylisobutyl ether, vinyl ketones such as vinylmethyl ketone and vinylhexyl ketone, vinyl aromatic compounds such as styrene, α-methylstyrene and vinyltoluene, olefins such as ethylene, propylene and 4-methylpentene, and diolefins such as butadiene and isoprene.

The above-mentioned vinyl aromatic copolymers may be so-called random copolymers, block copolymers or graft copolymers. Suitable copolymers are styrene/butadiene copolymers, vinyltoluene/butadiene copolymers, styrene/acrylic acid ester copolymers, vinyltoluene/acrylic acid ester copolymers, styrene/acrylic acid ester/butadiene copolymers, vinyltoluene/acrylic acid ester/butadiene copolymers and styrene-/ethylene copolymers.

In order to attain the objects of the present invention effectively and conveniently, it is preferred the vinyl aromatic units be present in an amount of at least 15 mole %, especially at least 50 mole %, in the vinyl aromatic resin that is used in the present invention.

The acrylic resin that can be used in this invention includes homopolymers and copolymers of such monomers as acrylic acid, acrylic acid esters, acrylamide, methacrylic acid and methacrylic acid esters, and as preferred examples of the acrylic resins, there can be mentioned polyacrylic acid esters, polymethacrylic acid esters, acrylic acid ester/methacrylic acid ester copolymers and acrylic acid ester/vinyl acetate copolymers.

As the polyvinyl acetal resin, there can be used acetalization products of saponified polyvinyl acetate, such as polyvinyl butyral and polyvinyl formal.

As the epoxy resin, there can be used bis- and tris-epoxy compounds obtained by reacting polyhydric phenols, polyhydric alcohols or resol type phenolic resins with epichlorohydrin. A typical instance of the epoxy resin is a bis-epoxy compound represented by the following formula:

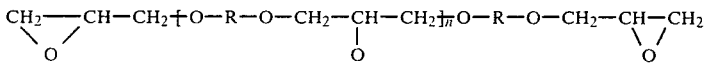

wherein R stands for a residue of a dihydric phenol, especially bis-2,2-(4-hydroxyphenyl)propane.

These epoxy resins may be used singly or in combination with reactive resins such as polyvinyl acetal resins, phenolic resins or acrylic resins.

As the polyester resin, there are used saturated polyester resins having a relatively low softening point, such as ethylene/butylene.terephthalate/isophthalate copolymers, ethylene/butylene.terephthalate/isophthalate/adipate copolymers, maleic acid resins, i.e., resins obtained from rosin-maleic anhydride adducts and polyhydric alcohols, and alkyd resins.

As the phenolic resin, there can be used resol type phenolic resins obtained by condensing carbolic acid, o-, m- or p-cresol, bisphenol A, p-tert-butyl-phenol, p-phenylphenol or other phenol with formaldehyde in the presence of an alkali catalyst, and these phenolic resins modified with rosin or xylene resins.

In general, it is preferred that the above-mentioned binder resins (B) have a relatively low molecular weight of 500 to 150,000, especially 1,000 to 100,000. Further, it is preferred that the melting temperature of the binder resin (B) is lower by at least 5° C., especially at least 10° C., than the melting temperature of the halogen- or nitrile-containing polymer (A). Further, when the halogen- or nitrile-containing polymer (A) is combined with the binder (B), in order to attain a high offset-preventing effect, it is especially preferred that both be chosen so that the halogen- or nitrile-containing polymer (A) is softened at the melting temperature of the binder (B).

In this invention, it is very important that the halogen- or nitrile-containing polymer (A) should be combined with the binder (B) at an (A)/(B) mixing weight ratio of from 1/20 to 1/1, especially from 1/10 to 1/2. When the amount of the halogen- or nitrile-containing polymer (A) is below the above range, no satisfactory offset-preventing effect can be obtained, and when the amount of the binder (B) is below the above range, the dispersion state specified in the present invention can hardly be attained and hence, a satisfactory offset-preventing effect cannot be obtained. Furthermore, in this case, the fixing property of the resulting developer tends to be degraded.

In the present invention, at least one member selected from coloring pigments, extender pigments, magnetic pigments and electrically conductive pigments is used as the pigment. Of course, pigments having at least two of the above-mentioned functions can be used. For example, carbon black having a function as a black pigment and a function as an electrically conductive pigment and triiron tetroxide having a function as a magnetic function and a function as a black pigment, as seen from its another name "black iron", can be used in the present invention.

Suitable examples of the coloring pigment that can be used in the present invention are as follows:

Black Pigments:

Carbon black, acetylene black, lamp black and aniline black.

Yellow Pigments:

Chrome yellow, zinc yellow, cadmium yellow, yellow iron oxide, Mineral Fast Yellow, nickel titanium yellow, naples yellow, Naphthol Yellow S, Hansa Yellow G, Hansa Yellow 10G, Benzidine Yellow C, Benzidine Yellow GR, Quinoline Yellow Lake, Permanent Yellow NCG and Tartrazine Lake.

Orange Pigments:

Chrome orange, molybdenum orange, Permanent Orange CTR, Pyrazolone Orange, Vulcan Orange, Indanthrene Brilliant Orange RK, Benzidine Orange G, Indanthrene Brillant Orange CK.

Red Pigments:

Red iron oxide, cadmium red, red lead, mercury sulfide, cadmium, Permanent Red 4R, Lithol Red, Pyrazolone Red, Watchung Red calcium salt, Lake Red D, Brilliant Carmine GB, Eosine Lake, Rhodamine Lake B, Alizarine Lake and Brilliant Carmine 3B.

Violet Pigments:

Manganese violet, Fast Violet B and Methyl Violet Lake.

Blue Pigments:

Prussian blue, cobalt blue, Alkali Blue Lake, victoria Blue Lake, Phthalocyanine Blue, metal-free Phthalocyanine Blue, partially chlorinated Phthalocyanine Blue, Fast Sky Blue and Indanthrene Blue BC.

Green Pigments:

Chrome green, chromium oxide, Pigment Green B, Malachite Green Lake and Fanal Yellow Green G.

White Pigments:

Zinc flower, titanium oxide, antimony white and zinc sulfide.

As the extender pigment that can be used in the present invention, there can be mentioned, for example, baryte powder, barium carbonate, clay, silica, white carbon, talc and alumina white.

As the magnetic pigment, there are known triiron tetroxide ($Fe_3O_4$), diiron trioxide ($\delta$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). Any of fine powders of these known magnetic substances can be used as the magnetic pigment in the present invention. A magnetic pigment especially suitable for attaining the objects of the present invention is triiron tetroxide.

As the electrically conductive pigment, there can be used any of inorganic fine powders which per se are not electrically conductive but have been rendered electrically conductive by the conducting treatment and various metal powders, in addition to the above-mentioned carbon black.

The amount of the pigment can be changed in a relatively broad range according to the intended use of the developer, but in general, the pigment is incorporated in an amount of 1 to 300% by weight based on the binder. In case of a two-component type developer, namely when the developer is used as the toner to be combined with a magnetic carrier, it is preferred that a coloring pigment be used in an amount of 1 to 15% by weight, especially 2 to 10% by weight, based on the binder, and in case of a one-component type magnetic, electrically conductive developer, it is preferred that a magnetic pigment be used in an amount of 50 to 300% by weight, preferably 100 to 250% by weight, based on the binder. In the latter case, a coloring pigment or electrically conductive pigment such as carbon black may be used in an amount of 1 to 15% by weight, especially 2 to 8% by weight, based on the binder in combination with the magnetic pigment according to need.

Known additives may be incorporated into the developer of the present invention according to known recipes. For example, in case of a two-component type developer, a known charge controlling agent, for example, an oil-soluble dye such as Nigrosine Base (CI 5045), Oil Black (CI 26150) or Spilon Black, a metal salt of naphthaenic acid, a fatty acid metal soap, a resin acid soap or a vinylpyridine homopolymer or copolymer may be incorporated in an amount of 0.1 to 5% by weight based on the binder.

PREPARATION OF DEVELOPER PARTICLES

The developer of the present invention is prepared by kneading a composition comprising a thermoplastic or rubbery polymer (A) containing halogen atoms or nitrile groups at a concentration of at least 100 milliequivalents per 100 g of the polymer and a binder (B) having a melting temperature lower than the melting temperature of the polymer (A) at an (A)/(B) mixing weight ratio of from 1/20 to 1/1 and further including a pigment (C), at a temperature higher than the melting temperature of the binder (A) but lower than the melting temperature of the polymer (A), and molding the kneaded composition into particles.

In the present invention, in order to prepare a developer having the dispersion state specified in the present invention, it is important to use the abovementioned polymer (A) and the binder (B) in combination and knead a composition comprising these polymer (A) and binder (B) at a temperature higher than the melting temperature of the binder (B) but lower than the melting temperature of the polymer (A). By adopting this specific kneading temperature, it is possible to obtain a developer composition in which particles of the polymer (A) are finely dispersed in the continuous phase of the binder (B).

As a result of experiments made by us, it has been confirmed that when the halogen- or nitrile-containing polymer (A) and the binder (B) are kneaded in the absence of a pigment under customary kneading conditions, namely at a temperature higher than the melting temperatures of both the components, there is obtained a semitransparent homogeneous composition. Namely, it has been confirmed that under such kneading conditions, the polymer (A) is rendered compatible with the binder (B). Developer particles of the composition in which the polymer (A) is in a state dissolved in the binder (B) have no offset-preventing effect at all at the fixing step. In contrast, when the kneading is carried out under the conditions specified in the present invention, namely at a temperature higher than the melting temperature of the binder (B) but lower than the melting temperature of the polymer (A), there is obtained a kneaded composition having a milky while appearance as a whole and it is observed that in this composition the polymer is dispersed in the form of fine particles in the continuous phase of the binder (B). Particles having this specific dispersion state have a prominently high offset-preventing effect.

The kneading can be accomplished according to any of known procedures except that the above-mentioned specific temperature condition is adopted. As the kneading means, there can be used, for example, a hot roll, a mixer and a kneader. The degree of kneading is not particularly critical, but in general, it is preferred that kneading be conducted to such an extent that the dispersed particles of the halogen- or nitrile-containing polymer (A) have a size smaller than $3\mu$, especially smaller than $0.5\mu$.

The so kneaded composition is then cooled to room temperature or a lower temperature and pulverized by a jet mill, a ball mill, a roll mill or other pulverizer. The pulverized composition is subjected to the sieving operation according to need. Thus, the developer particles are obtained.

Instead of the above kneading process, there may be adopted a process in which the respective components of the developer are stirred under conditions generating heat of friction in a high-speed stirrer such as a supermixer to melt the binder (B) and soften the polymer (A) and obtain developer particles in which the respective components are integrated with each other.

Further, instead of the process in which the cooled mixture is pulverized, there may be adopted a process in which a mixture of the respective components of the developer heated at the above-mentioned temperature is directly formed into developer particles by such means as spray granulation or centrifugal granulation.

Still further, there may be adopted a process in which a thermoplastic or rubbery polymer (A) containing halogen atoms or nitrile groups at a concentration of at least 100 milliequivalents per 100 g of the polymer and a vinyl aromatic polymer (B') as the binder are dissolved or dispersed at a weight ratio (A)/(B') of from 1/20 to 1/1 in a mixed solvent of a polar organic solvent capable of dissolving the polymer (A) and an arcmatic solvent, a pigment (C) is dispersed in the solution or dispersion, and the resulting composition is spraydried in a drying atmosphere to obtain developer particles.

The vinyl aromatic polymer (B') as the binder is much superior to the halogen- or nitrile-containing polymer (A) with respect to the solubility in organic solvents, and therefore, when both the polymers are incorporated in a mixed solvent of a polar organic solvent capable of dissolving the polymer (A) therein and an aromatic solvent, the binder (B') forms a continuous phase but the halogen- or nitrile-containing polymer (A) is dispersed in this continuous phase, whereby the intended dispersion state is formed. This can be confirmed from the fact that the resulting dispersion has a milky white appearance resembling an emulsion. When the so formed dispersion is spray-dried in a drying atmosphere, a developer having the dispersion state specified in the present invention can be obtained.

As the aromatic solvent, there can be used, for example, benzene, toluene, xylene, tetrahydronaphthalene, ethyl benzene and mixtures thereof. In order to attain a good dispersion of the halogen- or nitrile-containing polymer (A) and make the size of dispersed particles thereof finer, it is important to use a polar organic solvent compatible with the organic solvent, such as a ketone, e.g., acetone, methylethyl ketone or methylisobutyl ketone, or an ether, e.g., tetrahydrofuran or dioxane. It is preferred that the polar solvent be used in an amount of 5 to 30% by weight, especially 5 to 15% by weight, based on the aromatic solvent.

It is preferred that such mixed organic solvent be used in an amount of 1 to 50% by weight based on the binder, and that the amount of the solvent be adjusted within this range so that the solid content of the starting dispersion in which the pigment has been incorporated is in the range of from 2 to 50% by weight. When the so formed starting dispersion is spray-dried. The dispersion is maintained at a temperature of 5° to 100° C. and it is sprayed into a gas such as air. nitrogen, carbon dioxide gas or combustion gas heated at a temperature of 50° to 150° C. through such a mechanism as a one-fluid nozzle, a two-fluid nozzle, a centrifugal spray nozzle or a rotary disc, whereby particles are formed.

DEVELOPER

In the present invention, it is preferred that the number average particle size of the developer be in the range of from 2 to 80μ, especially from 5 to 50μ, though the preferred range of the particle size varies to some extent depending on the preparation process or the intended use. Moreover, it is preferred that the particle size distribution of the developer be such that particles having a size larger than 50μ occupy less than 20% of the total particles and particles having a size smaller than 5μ occupy less than 15% of the total particles.

It is preferred that the shape of the developer particles be substantially spherical. However, since the developer of the present invention contains the macromolecular halogen- or nitrile-containing polymer instead of the parting substance, even if the developer particles have an amorphous shape such as a shape resembling that of said particles, pulverized particles or granules or they are angular particles, an excellent flowability and a high blocking resistance (reduced tendency to agglomerate) can be maintained in the developer of the present invention. This is another advantage of the developer of the present invention.

The developer of the present invention may be subjected to various post treatments according to the intended use thereof. For example, when the developer of the present invention is used as a one-component type develper, namely an electrically conductive magnetic developer, a necessary electric conductivity can be imparted to the developer by causing electrically conductive fine particles (B) to adhere to the surfaces of particles (A) containing a magnetic pigment (magnetosensitive fixing particles). As the electrically conductive fine particles (B), various carbon blacks such as furnace black and channel black are preferred, and Colax L (electrically conductive carbon black manufactured by Dagusse Co.) and Vulcan XC-72R (electrically conductive carbon black manufactured by Cabot Corp.) are especially preferred. In addition, there can be used inorganic fine particles treated with an electric conducting agent or metal powders as the electrically conductive fine particles (B). These electrically conductive fine particles (B) may be physically adsorbed and retained on the surfaces of the particles (A) by dry blending or they may be positively embedded in the surfaces of the particles (A) by fusion bonding or the like. It is preferred that the electrically conductive fine particles (B) be used in an amount of 0.01 to 5% by weight, especially 0.1 to 2% by weight, based on the particles (A).

The developer of the present invention can be used broadly for developing electrostatic images in the electrostatic photographic copying process, the electrostatic printing process, the electrostatic recording process and the like.

Development of electrostatic latent images can be accomplished according to known developing methods, especially the magnetic brush method. As will readily be understood from the fact that the angle of reopose of the developer of the present invention in the range of 10° to 70°, especially 30° to 60°, the developer of the present invention has a very excellent flowability. Further, as is seen from the fact that the cohesion ratio (Rc), represented by the following formula, of the developer of the present invention is lower than 10%, especially lower than 5%, the tendency of agglomeration or cohesion of the developer particles is remarkably reduced:

$$Rc = X/Xo \times 100$$

wherein Xo stands for the weight (g) of the developer particles which pass through a 200-mesh sieve, and X stands for the weight (g) of the developer particles left on the 200-mesh sieve after the developer particles which have passed through the 200-mesh sieve are heated at 50° C. for 60 minutes.

By virtue of the above-mentioned characteristic properties of the developer of the present invention, when the developer of the present invention is employed, such troubles as contamination of the background by fall-down of the developer particles and blurring of an image by uneven adhesion of the developer particles can be effectively prevented. Furthermore, cohesion or agglomeration of the developer particles by rise of the temperature in a developer storing zone of the developing apparatus can be effectively prevented.

Since the offset-preventing effect can be attained without use of a parting substance in the present invention, when the developer of the present invention is used, there can be attained a prominent advantage that contamination of the magnetic carrier or the electrostatic photographic photosensitive plate (master) can be effectively prevented. In known offset-preventing toners including a relatively large quantity of a parting substance or lubricant, such offset-preventing substance adheres to the magnetic carrier and is gradually accumulated thereon to cause degradation of the magnetic carrier. Further, in the copying or printing process of the type where toner particles or developer particles are transferred to a transfer sheet from a photosensitive plate and the photosensitive plate is used repeatedly, such offset-preventing substance adheres to the photosensitive plate and is gradually accumulated thereon to cause the above-mentioned various disadvantages. In contrast, in case of the developer of the present invention, there is not a fear that such parting substance shafts and adheres to the carrier or photosensitive plate, and the life of the carrier or photosensitive plate can be prominently prolonged.

Further, when the parting substance heretofore incorporated in toners is used in an amount sufficient to attain a substantial offset-preventing effect, bad influences are often imposed on charge properties of the toner particles, such as the charge polarity and charge quantity, causing so-called fogging or resulting in reduction of the image density (see Comparative Example 1 given hereinafter). In case of the developer of the present invention, since such parting substance is not used as the offset-preventing agent, no bad influences are given to the charge characteristics of the developer particles.

An image of the developer particles formed by the development is fixed under application of pressure or heat as it is or after it has been transferred onto a transfer sheet. A pair of pressing metal rolls can be used for pressure fixation, and a polytetrafluoroethylene-coated roller having a heating mechanism installed in the interior thereof can be used for heat fixation. In each case, occurrence of the phenomenon that the developer of the present invention is transferred to the roll surface, namely the offset phenomenon, can be prevented completely. In general, heat fixation may be carried out at temperatures within a relatively broad range of 140° to 200° C. and pressure fixation can be accomplished under a roller pressure of 200 to 500 $Kg/cm^2$, though these temperature and pressure conditions vary to some extent depending on the kind of the binder contained in the developer.

The reason why the developer of this invention has an excellent offset-preventing effect at the fixing step has not yet been sufficiently clarified. However, it is construed that this excellent function of the developer of this invention may probably be owing to the following facts. Namely, in view of the fact that the halogen- or nitrile-containing polymer present in the form of dispersed particles is effective for prevention of occurrence of the offset phenomenon, the halogen- or nitrile-containing polymer has a repelling action to the fixing roller by the influence of electric negativity of the halogen atom or nitrile group contained in the polymer. Further, the binder (B) in the molten state is attracted to the particles of the halogen- or nitrile-containing polymer more strongly than to the fixing roller.

Excellent effects attained by the present invention will now be described in detail by reference to the following Examples that by no means limit the scope of the invention.

Comparative Example 1

In this Example, it is illustrated that the developer of the present invention containing a halogen- or nitrile-containing polymer is much excellent over a developer containing a known parting agent with respect to the photocopying and developing characteristics.

1. Developer Compositions Used at Comparative Tests:

(a) Developer Composition of Present Invention:

| | |
|---|---|
| Styrene resin (Piccolastic D-150 manufactured by Esso Petrochemical) | 40 parts by weight |
| Styrene/acrylate copolymer (Pliolite AC manufactured by Goodyear) | 60 parts by weight |
| Nigrosine Base EX (manufactured by Orient Chemical) | 2 parts by weight |
| Vinyl chloride/vinyl acetate copolymer resin (Hostaflex VP-150 manufactured by Hoechst AG.) | 30 parts by weight |
| Carbon black (Special Black #4 manufactured by Mitsubishi Kasei) | 6 parts by weight |

(b) Developer Composition Including Known Parting Agent:

The developer composition was prepared by using the same compounds as in the developer composition (a) of the present invention except that 12 parts by weight of low-molecular-weight polypropylene (Viscol 550P manufactured by Sanye Kasei) was used instead of 30 parts by weight of the vinyl chloride/vinyl acetate copolymer.

(c) Developer Composition Free of Parting Agent:

The developer composition was prepared by using the same components as in the developer composition (a) of the present invention except that 30 parts by weight of the vinyl chloride/vinyl acetate copolymer was not incorporated.

(d) Developer Composition of Present Invention:

| | |
|---|---|
| Styrene resin (Piccolastic D-150 manufactured by Esso Petrochemical) | 40 parts by weight |
| Styrene/acrylate copolymer (Pliolite AC manufactured by Goodyear) | 60 parts by weight |
| Nigrosine Base EX (manufactured by Orient Chemical) | 2 parts by weight |
| Carbon black (Printex 140 manufactured by Degussa Co.) | 6 parts by weight |
| Acrylonitrile/butadiene rubber (Chemigum N-612A manufactured by Goodyear) | 30 parts by weight |

The components of each composition were mixed, and the mixture was kneaded at 150°±5° C. for about 25 minutes in a mill including three hot rolls. The kneaded mixture was cooled to room temperature (10° to 20° C.) to solidify the mixture. Then, the kneaded mixture was roughly pulverized by a feather mill and then finely pulverized by an ultrasonic jet mill pulverizer (Jet Mill Model I manufactured by Nippon Pneumatic Co.) to obtain a developer having a particle size distribution range of from 5 to 30μ.

The copying and developing characteristics of the so obtained developers were determined according to the measurement methods described below.

2. Measurement Methods:

(A) Offset-Preventing Effect (Resistance to Offsetting to Fixing Roller):

50 g of a sample developer was homogeneously mixed with 950 g of an iron powder carrier (EPV 200-300 manufactured by Nippon Teppun), and the mixture was charged in a developer bottle of an electrostatic copying machine (installed with a heat-fixing roller coated with a tetrafluoroethylene resin) manufactured by Mite Industrial Co. An original having an image was reproduced at a fixing temperature of 180°±3° C., and the contamination of the fixing roller and the offset state of the copied image were examined with the naked eye.

(B) Flowability (Angle of Repose) of Developer:

A sample developer was packed in a cylindrical glass vessel (having a capacity of 600 ml) and the free surface was levelled horizontally. The packed vessel was inclined, and the inclination angle at which the developer particles present in the surface portion began to slip was measured by a protractor.

(C) Cohesiveness:

30 g of a sample developer was precisely weighed and classified by a 200-mesh sieve. The weight of the developer particles passing through the 200-mesh sieve was precisely measured, and those particles were charged in a broad-mouthed glass vessel and heated and dried for 60 minutes in a drier maintained at 50° C. Then, the particles were classified by the 200-mesh sieve again and the weight of the developer particles left on the 200-mesh sieve was measured to evaluate the cohesiveness.

(D) Adaptability to Continuous Copying Operation (Contamination of Master and Fogging of Print):

50 g of a sample developer was homogeneously mixed with 950 g of an iron powder carrier (EFV 200–300 manufactured by Nippon Teppun), and the mixture was charged in a developer bottle of an electrostatic copying machine Model 251 manufactured by Mita Industrail Co. (installed with a heat-fixing roller coated with a tetrafluoroethylene resin). The continuous copying operation was carried out at a fixing temperature of 180°±3° C. by using an original having an image. Every time a prescribed number of prints were obtained, the operation was temporarily stopped, the contamination of the master, the fogging state in the obtained prints and the developer supply state were examined with the naked eye.

Incidentally, an appropriate amount of the developer was charged in a supply vat and the developer was continuously supplied therefrom.

Obtained results are shown in Table 1.

TABLE 1

| Test Items | Developer (a) of Present Invention | Comparative Developer (b) | Comparative Developer (c) | Developer (d) of Present Invention |
|---|---|---|---|---|
| Offset Resistance | good | good | good | good |
| Flowability | 45° | 70° | 85° | 50° |
| Cohesiveness | | | | |
| untreated particle sieve residue (% by weight) | 7.6 | 16.7 | 53.3 | 8.0 |
| cohesion ratio(Rc) | 4.3% | 15.0% | 48.0% | 4.5% |
| Adaptability to Continuous Operation | | | | |
| contamination of master | | | | |
| 50th print | good | good | bad | good |
| 100th print | good | good | bad | good |
| 200th print | good | bad | bad | good |
| 500th print | good | bad | bad | good |
| fogging state | | | | |
| 50th print | good | good | fogging caused | good |
| 100th print | good | bad | even in first | good |
| 200th print | good | bad | print | good |
| 500th print | good | bad | | good |
| developer supply state | | | | |
| 100th print | good | bad | bad | good |
| 200th print | good | bad | bad | good |
| 500th print | good | bad | bad | good |

As will readily be understood from the results shown in Table 1, the developer of the present invention is remarkably excellent over the comparative developers with respect to the offset resistance, the flowability, the cohesiveness and the adaptability to the continuous operation.

Comparative Example 2

By the following experiments, it has been confirmed that the halogen atom concentration in the halogen-containing polymer of the present invention should be at least 100 milliquivalents (100 milligram atoms) per 100 g of the polymer.

Compositions Used at Comparative Tests:

| | |
|---|---|
| Styrene resin (Piccolastic D-150 manufactured by Esso Petrochemical) | 40 parts by weight |
| Styrene/acrylate copolymer (Pliolite AC manufactured by Goodyear) | 60 parts by weight |
| Nigrosine Base EX (manufactured by Orient Chemical) | 2 parts by weight |
| Special Black #4 (manufactured by Mitsubishi Kasei) | 6 parts by weight |
| Halogen-containing polymer (shown in Table 2) | 30 parts by weight |

The components of each composition were mixed, and the mixture was kneaded at 150°±5° C. for about 25 minutes in a mill including three hot rolls. The kneaded mixture was cooled to room temperature (10° to 20° C.) to solidify the mixture. Then, the kneaded mixture was roughly pulverized by a feather mill (manufactured by Hosokawa Tekkosho) and then finely pulverized by an ultrasonic jet mill pulverizer (Jet Mill Model I manufactured by Nippon Pneumatic Co.) to obtain a developer having a particle size distribution range of from 5 to 30μ. Thus, developers A', B', C', D', E', F', G' and H' were obtained.

50 g of each sample developer was homogeneously mixed with 950 g of an iron powder carrier (EFV 200–300 manufactured by Nippon Teppun), and the mixture was charged in a developer bottle of an electrostatic copying machine (installed with a heat-fixing roller coated with Teflon) manufactured by Mita Industrial Co. An original having an image was reproduced at a fixing temperature of 180°±5° C., and the fixing property and the offsetting to the Teflon-coated fixing roller were examined according to the following methods.

Measurement Methods:

Fixing Property:

The image area of the resulting print was rubbed 50 times with a friction resistance tester (crockmeter), and the fixing property was evaluated with the naked eye.

Resistance to Offsetting to Fixing Roller:

The offset resistance was evaluated according to the same method as described in Comparative Example 1.

Obtained results are shown in Table 3.

TABLE 2

| Composition | Resin used | Chlorine Content (mg-atoms per 100 g of polymer) |
|---|---|---|
| A | polyvinyl chloride | 1600 |
| B | vinyl chloride/vinyl acetate (95/5) copolymer resin | 1492 |
| C | vinyl chloride/vinyl acetate (85/15) copolymer resin | 1287 |
| D | vinyl chloride/vinyl acetate (70/30) copolymer resin | 1006 |

TABLE 2-continued

| Composition | Resin used | Chlorine Content (mg-atoms per 100 g of polymer) |
|---|---|---|
| E | vinyl chloride/vinyl acetate (50/50) copolymer resin | 673 |
| F | vinyl chloride/vinyl acetate (30/70) copolymer resin | 379 |
| G | vinyl chloride/vinyl acetate (15/85) copolymer resin | 180 |
| H | vinyl chloride/vinyl acetate (5/95) copolymer resin | 59 |

Note:
These copolymer resins were prepared according to the conventional polymerization method customarily adopted in the art.

TABLE 3

| Developer | Fixing Property | Offset Resistance |
|---|---|---|
| A' | good | good |
| B' | good | good |
| C' | good | good |
| D' | good | excellent |
| E' | good | excellent |
| F' | good | good |
| G' | good | relatively bad |
| H' | good | bad |

Comparative Example 3

By the following experiments, it has been confirmed that the amount of the halogen-containing polymer of the present invention to be incorporated into the binder resin is limited in a certain range.

Developer Compositions Used at Comparative Tests:

| | |
|---|---|
| Styrene resin (Piccolastic D-150 manufactured by Esso Petrochemical) | 40 parts by weight |
| Styrene/acrylate copolymer (Pliolite AC manufactured by Goodyear) | 60 parts by weight |
| Nigrosine Base EX (manufactured by Orient Chemical) | 2 parts by weight |
| Carbon black (Special Black #4 manufactured by Mitsubishi Kasei) | 6 parts by weight |
| Vinyl Chloride Resin (Geon 121 manufactured by Japanese Geon) | as shown in Table 4 |

Developers a', b', c', d', e' and f' were prepared from the above components in the same manner as described in Comparative Example 1, and the properties of each developer were evaluated according to the methods described in Comparative Examples 1 and 2. Further, the luster of each of the obtained prints was examined with the naked eye. Obtained results are shown in Table 5.

TABLE 4

| Composition | Amount (parts by weight) of Vinyl Chloride Resin |
|---|---|
| a | 200 |
| b | 150 |
| c | 100 |
| d | 50 |
| e | 5 |
| f | 1 |

TABLE 5

| Composition | Developer | Yield (%) of Developer | Fixing Property | Luster of Print | Offset Resistance |
|---|---|---|---|---|---|
| a | a' | 5-10 | bad | bad | good |
| b | b' | 40-60 | bad | slightly lustrous | good |
| c | c' | 70-80 | good | good | good |
| d | d' | above 80 | good | good | good |
| e | e' | above 80 | good | good | slightly bad |
| f | f' | above 80 | good | good | bad |

From the foregoing results, it is seen that when the amount of the halogen-containing polymer is too large, since the halogen-containing polymer is inherently soft but is tightly solidified and agglomerated, pulverization of the composition becomes difficult and it is difficult to obtain particles having an optimum size, whereby the yield of the developer is reduced. Further, the copied image becomes lustrous and flow of the image is caused. On the other hand, when the amount of the halogen-containing polymer is too small, the offset-preventing effect is drastically lowered.

Comparative Example 4

In order to clarify that in the developer of the present invention containing the halogen-containing polymer, the dispersion state of particles of the halogen-containing polymer is changed according to the preparation conditions and the adhesion or fixation of the developer to the fixing roller or copying sheet is influenced by this change of the dispersion state, the following experiments were conducted.

Developer Compositions Used at Comparative Tests:

(1) Composition to be Used for Preparation Method Using Hot Roll Mill:

| | |
|---|---|
| Styrene resin (Piccolastic D-150 manufactured by Esso Petrochemical) | 40 parts by weight |
| Styrene/acrylate copolymer (Pliolite AC manufactured by Goodyear) | 60 parts by weight |
| Nigrosine Base EX (manufactured by Orient Chemical) | 2 parts by weight |
| Vinyl chlordie/vinyl acetate copolymer resin (Hostaflex VP-150 manufactured by Hoechst AG.) | 30 parts by weight |
| Carbon black (Special Black #4 manufactured by Mitsubishi Kasei) | 6 parts by weight |

The components were mixed, and the mixture was kneaded at 110°±5° C., 150°±5° C. or 190°±5° C. for about 25 minutes in a mill including three hot rolls. The kneaded mixture was solidified and pulverized in the same manner as described in Comparative Example 1. Separately, the above components were charged in the hot three-roll mill and kneaded at 150°±5° C. for 3, 5, 10, 20 or 30 minutes. The kneaded mixture was cooled and Pulverized in the same manner as described in Comparative Example 1.

(2) Compositions to be Used for Spray Granulation:

Composition (I) (Dispersion of Halogen-Containing Polymer):

| | |
|---|---|
| Styrene resin (Piccolastic D-150 | 40 parts by weight |

-continued

| | |
|---|---|
| manufactured by Esso Petrochemical) | |
| Styrene/acrylate copolymer (Pliolite AC manufactured by Goodyear) | 60 parts by weight |
| Nigrosine Base EX (manufactured by Orient Chemical) | 2 parts by weight |
| Vinyl chloride/vinyl acetate copolymer resin (Hostaflex VP-150 manufactured by Hoechst AG.) | 30 parts by weight |
| Carbon black (Special Black #4 manufactured by Mitsubishi Kasei) | 6 parts by weight |
| Toluene | 750 parts by weight |
| Methylethyl ketone | 50 parts by weight |

Composition (II) (Solution of Halogen-Containing Polymer):

The composition (II) was prepared in the same manner as the above composition (I) except that the amount used of methylethyl ketone was changed to 400 parts by weight and the amount used of toluene was changed to 400 parts by weight.

The above compositions (I) and (II) were separately charged in a KVM dispersing machine and stirred at a liquid temperature of 30° to 50° C. for 30 minutes to form homogeneous dispersions. Each dispersion was spray-granulated under an air pressure of 2.5 kg/cm$^2$ by using a spray granulator having spray nozzles 16 mm in diameter. The so obtained developer particles (I') and (II') were sieved and calssified to recover developer particles having a particle size of 5 to 30$\mu$.

The fixing property and offset resistance (resistance to offsetting to the fixing roller) of each of the developers prepared by the above-mentioned methods (1) and (2) were determined according to the methods described in Comparative Examples 1 and 2 to obtain results shown in Table 6.

TABLE 6

| | Fixing Property | Offset Resistance |
|---|---|---|
| Method Using Hot Three-Roll Mill | | |
| Kneading Temperature | | |
| 110 ± 5° C. | kneading was impossible | |
| 150 ± 5° C. | good | good |
| 190 ± 5° C. | good | bad |
| Kneading Time | | |
| 3 minutes | bad | bad |
| 5 minutes | bad | bad |
| 10 minutes | good | good |
| 20 minutes | good | good |
| 30 minutes | good | good |
| Spray Granulation Method | | |
| (I') | good | good |
| (II') | good | bad |

From the results shown in Table 6, it is seen that it is certain that the dispersion state of the halogen-containing polymer in the developer is changed according to the kneading means, the kneading temperature and the kneading time and this change of the dispersion state results in conspicuous differences of the developing characteristics of the developer. Also from the above results, it is seen that the kneading temperature should be lower than the melting temperature of the halogen-containing polymer and the kneading time should be such that the halogen-containing polymer is homogeneously dispersed.

In case of the spray granulation method, as seen from the above results, it is indispensable that the halogen-containing polymer should not be completely dissolved but should be homogeneously dispersed so that a milky white dispersion is obtained. It will also be apparent that a developer having desirable properties can be prepared by spray granulation of such milky white emulsion.

Comparative Example 5

By the following experiments, it has been confirmed that the nitrile group concentration in the nitrile-containing polymer of the present invention has significant influences on the offset-preventing effect.

Developer Compositions Used at Comparative Tests:

| | |
|---|---|
| Styrene resin (Piccolastic D-150 manufactured by Esso Petrochemical) | 40 parts by weight |
| Styrene/acrylate copolymer (Pliolite AC manufactured by Goodyear) | 60 parts by weight |
| Nigrosine Base EX (manufactured by Orient Chemical) | 2 parts by weight |
| Carbon black (Special Black #4 manufactured by Mitsubishi Kasei) | 6 parts by weight |
| Niitrile-containing polymer (shown in Table 7) | 30 parts by weight |

The above components were appropriately mixed and the mixture was kneaded for 25 minutes homogeneously by a hot three-roll mill (maintained at 150° to 200° C.). The kneaded mixture was sufficiently cooled and solidified at room temperature. The solidified mixture was roughly pulverized by a feather mill and finely pulverized by an ultrasonic jet mill pulverizer (Jet Mill Model I manufactured by Nippon Pneumatic Co.). The resulting particles were classified by an air classifier to obtain particles having a particle size of 5 to 30$\mu$. Thus, there were obtained developers a', b', c', d', e', f' and g'. The developing characteristics (flowability and cohesiveness) of each developer were determined according to the methods described in Comparative Example 1. Further, 50 g of each developer was mixed with iron powder as a carrier (EFV 200-300 manufactured by Nippon Teppun), the mixture was filled in a fixing tester equipped with a Teflon-coated roller for heat fixation (manufactured by Mita Industrial Co.), a copied image was formed at a fixing temperature of 180°±5° C. and the offset-preventing effect, fixing property and adaptability to the continuous copying operation were determined according to the methods described in Comparative Examples 1 and 2. Obtained results are shown in Table 8.

The nitrile-containing polymers used in the comparative tests were prepared in the following manner.

In a polymerization vessel equipped with a stirrer, 180 parts by weight of water was charged, and a solution formed by dissolving 4.5 parts by weight of soap flake and 0.6 part by weight of stearic acid in 50 parts by weight of water at about 60° C. was added. Then, a solution of 0.3 part by weight of potassium chloride, 0.1 part by weight of sodium phosphate and 0.02 part by weight of iron sulfate in 5 parts by weight of water was incorporated into the charge of the polymerization vessel. Then, acrylonitrile was added to the mixture and 0.5 part by weight of t-dodecylmercaptan was added. Then, butadiene was further added. The total amount of acrylonitrile and butadiene was 100 parts by weight, and the molar ratio of acrylonitrile and butadien was as shown in Table 7. Then, 0.35 part by weight of hydrogen peroxide was added and 125 parts by weight of water was further added to the mixture. Emulsion polymerization was conducted with stirring at 30° C. under pressure for 24 hours. In order to prevent oxidation of the resulting polymer, 2 parts by weight of phenyl-β-naphthylamine was added to the reaction mixture, and 0.5 part by weight of sodium alkylbenzenesulfonate and 40 parts by weight of a saturated aqueous solution of sodium chloride were added to the reaction mixture and the pH was adjusted to 3 by addition of sulfuric acid to coagulate and precipitate the polymer. The polymer was recovered by filtration, washed and dried at about 60° C. to obtain a polymer to be used for the experiment.

TABLE 7

| Composition | Polymer Used | Nitrile Group Concentration (millimole per 100 g of polymer) |
|---|---|---|
| a | polyacrylonitrile | 1887 |
| b | acrylonitrile/butadiene copolymer (molar ratio = 4/1) | 1504 |
| c | acrylonitrile/butadiene copolymer (molar ratio = 1/1) | 935 |
| d | acrylonitrile/butadiene copolymer (molar ratio = 2/3) | 746 |
| e | acrylonitrile/butadiene copolymer (molar ratio = 1/3) | 465 |
| f | acrylonitrile/butadiene copolymer (molar ratio = 1/5) | 310 |
| g | acrylonitrile/butadiene copolymer (molar ratio = 1/9) | 169 |

per 100 g of the polymer, no substantial offset-preventive effect can be attained and the developer cannot be practically used. When the nitrile concentration is higher than 1600 millimoles per 100 g of the polymer, the melting temperature becomes very high because of the inherent characteristic of the nitrile group and kneading is impossible at 200° C. Accordingly, at such high nitrile concentration, the intended developer cannot be prepared.

EXAMPLE 1

Two-component type developer composition:

| | | |
|---|---|---|
| Styrene resin (Piccolastic D-150 manufactured by Esso Petrochemical) | 75 | parts by weight |
| Styrene/acrylate copolymer (Pliolite AC manufactured by Goodyear) | 25 | parts by weight |
| Oil-soluble dye (Nigrosine Base EX manufactured by Orient Chemical) | 2.2 | parts by weight |
| Carbon black (Carbon #30 manufactured by Mitsubishi Kasei) | 6.6 | parts by weight |
| Vinyl chloride/vinyl acetate/unsaturated dibasic acid copolymer (Hostaflex M-133 manufactured by Hoechst AG.) | 10 | parts by weight |

A mixture comprising the above components was homogeneously kneaded at 150° C. in a hot roll mill, and the mixture was cooled to room temperature (10° to 20° C.) to solidify the mixture. Then, the solidified mixture was finely pulverized by an ultrasonic jet mill pulverizer to obtain a developer having an average particle size of about 5 to about 30μ. The copying operation was carried out by using the so obtained developer in a copying machine Electronic Copystar Model 251R manufactured by Mita Industrial Co. (installed with a heat-fixing roller coated with Teflon). No contamina-

TABLE 8

| Test Items | Developer a' | Developer b' | Developer c' | Developer d' | Developer e' | Developer f' | Developer g' |
|---|---|---|---|---|---|---|---|
| Offset Resistance | — | good | good | good | good | slightly bad | bad |
| Flowability | — | 37° | 41° | 45° | 55° | 67° | 80° |
| Cohesiveness | | | | | | | |
| untreated particle sieve residue (% by weight) | — | 6.0 | 6.7 | 7.5 | 8.9 | 15.5 | 47.3 |
| cohesion ratio (Rc) | — | 3.5% | 4.0% | 4.5% | 6.6% | 14.2% | 4.0% |
| Adaptability to Continuous Operation | | | | | | | |
| contamination of master | | | | | | | |
| 50th print | — | good | good | good | good | good | bad |
| 100th print | — | good | good | good | good | slightly bad | bad |
| 200th print | — | good | good | good | good | bad | bad |
| 500th print | — | good | good | good | good | bad | bad |
| fogging state | | | | | | | |
| 50th print | — | good | good | good | good | good | bad |
| 100th print | — | good | good | good | good | slightly bad | bad |
| 200th print | — | good | good | good | good | bad | bad |
| 500th print | — | good | good | good | good | bad | bad |
| developer supply state | | | | | | | |
| 100th print | — | good | good | good | good | good | bad |
| 200th print | — | good | good | good | good | slightly bad | bad |
| 500th print | — | good | good | good | good | bad | bad |
| Fixing Property | — | good | good | good | good | good | good |

As will be apparent from the results shown in Table 8, the properties of the developer are changed according to the nitrile concentration in the nitrile-containing polymer. More specifically, when the nitrile concentration is lower than 200 millimoles (200 milliequivalents)

tion was observed on the surface of the heat-fixing roller and clear images free of the offset phenomenon were obtained. Even if the foregoing operation was repeated to obtain 1000 prints, no contamination was observed on the surface of the fixing roller and clear prints free of the offset phenomenon were obtained.

EXAMPLE 2

Two-component type developer composition:

| | |
|---|---|
| Styrene/acrylate copolymer (Kanebilac manufactured by Kanegafuchi Chemical) | 80 parts by weight |
| Saturated polyester resin (Vylon 300 manufactured by Toyobo) | 20 parts by weight |
| Oil-soluble dye (Oil Black HBB manufactured by Orient Chemical) | 2.5 parts by weight |
| Carbon black (Leaven 15 manufactured by Columbia Carbon) | 6.0 parts by weight |
| Vinyl chloride/vinyl acetate copolymer (Hostaflex VP-150 manufactured by Hoechst AG.) | 5.0 parts by weight |

A mixture comprising the above components was treated to form a developer and the copying operation was carried out in the same manner as described in Example 1 by using Copystar 251R, and the contamination of the fixing roller with the developer and occurrence of the offset phenomenon were examined. Obtained results were the same as those obtained in Example 1.

EXAMPLE 3

Two-component type developer composition:

| | |
|---|---|
| Styrene resin (Dick Elastyrene #200 manufactured by Dick Elastyrene Co.) | 50 parts by weight |
| Vinyl toluene/acrylate copolymer (Pliolite VTAC manufactured by Goodyear) | 50 parts by weight |
| Oil-soluble dye (Oil Black HBB manufactured by Orient Chemical) | 3.0 parts by weight |
| Carbon black (Special Black IV manufactured by Degussa Co.) | 7.8 parts by weight |
| Chloroprene rubber (Neoprene manufacured by Du Pont) | 30 parts by weight |

A mixture comprising the above components was treated to form a developer and the copying operation was carried out in the same manner as in Example 1 by using Copystar 251R. The contamination of the fixing roller with the developer and occurrence of the offset phenomenon were examined. Obtained results were the same as those obtained in Example 1.

EXAMPLE 4

Two-component Type Developer Composition:

| | |
|---|---|
| Acrylic resin (Palaroid B-66 manufactured Rohm & Haas) | 50 parts by weight |
| Vinyl toluene/butadiene copolymer (Pliolite VT manufactured by Goodyear) | 50 parts by weight |
| Oil-soluble dye (Nigrosine Base EX manufactured by Orient Chemical) | 2.5 parts by weight |
| Carbon black (Special Black IV manufactured by Degussa Co.) | 7.5 parts by weight |

-continued

| | |
|---|---|
| Vinyl chloride/acrylonitrile copolymer | 15 parts by weight |

A mixture comprising the above components was kneaded at 160° C. by a heating kneader to form a homogeneous dispersion. The dispersion was cooled to room temperature (10° to 20° C.) to solidify the dispersion. The solidified dispersion was pulverized by a jet mill pulverizer to form a developer having an average particle size of about 5 to about 30$\mu$. By using the obtained developer, the copying operation was carried out in an electrophotographic copying machine Copystar 251R manufactured by Mita Industrial Co. No contamination of the heat fixing roller was observed and clear prints having copied images free of the offset phenomenon were obtained. Even if the copying operation was continued, good results were similarly obtained.

EXAMPLE 5

Two-component type developer composition:

| | |
|---|---|
| Acrylic resin (Paraloid B-66 manufactured by Rohm & Haas) | 50 parts by weight |
| Vinyl toluene/butadiene copolymer (Pliolite VT manufactured by Goodyear) | 50 parts by weight |
| Oil-soluble dye (Nigrosine Base EX manufactured by Orient Chemical) | 2.5 parts by weight |
| Carbon black (Special Black IV manufactured by Degussa Co.) | 7.5 parts by weight |
| Vinyl chloride/acrylonitrile copolymer | 15 parts by weight |
| Toluene | 650 parts by weight |
| Acetone | 50 parts by weight |

A mixture comprising the above components was agitated for 24 hours by a ball mill to form a homogeneous dispersion. The dispersion was spray-dried by a spray drier (hot air temperature being 150° C.) to obtain a developer having an average particle size of about 5 to about 30 microns. By using the so formed developer, the copying operation was carried out in a copying machine Electronic Copystar 251R manufactured by Mita Industrial Co. No contamination of the heat fixing roller was observed and clear copies free of the offset phenomenon were obtained. Even if the foregoing operation was continuously repeated, obtained results were the same as above.

EXAMPLE 6

Two-component type developer composition:

| | |
|---|---|
| Styrene/acrylate copolymer (Pliolite AC manufactured by Goodyear) | 80 parts by weight |
| Coumarone-indene resin (Picco N Resin manufactured by Picco Co.) | 24 parts by weight |
| Oil-soluble dye (Oil Black HBB manufactured by Orient Chemical) | 4.1 parts by weight |
| Carbon black (Special Black IV manufactured by Degussa Co.) | 40.5 parts by weight |
| Vinyl chloride resin (Georesin 103ZX manufactured by Japanese Geon) | 31.2 parts by weight |
| Toluene | 750 parts by weight |

-continued

| | | |
|---|---|---|
| Methylethyl ketone | 50 | parts by weight |

A mixture comprising the above components was treated and the copying operation was carried out in the same manner as described in Example 5 by using Copystar 251R. The contamination of the fixing roller with the toner and occurrence of the offset phenomenon were examined. Obtained results were the same as those obtained in Example 5.

EXAMPLE 7

Two-component type developer composition:

| | | |
|---|---|---|
| Vinyl toluene-butadiene copolymer (Pliolite VT-L manufactured by Goodyear) | 70 | parts by weight |
| Styrene resin (Amoco Resin 18-240 manufactured by Amoco Chemicals) | 32 | parts by weight |
| Oil-soluble dye (Oil Black HBB manufactured by Orient Chemical) | 4.7 | parts by weight |
| Carbon Black (Carbon #30 manufactured by Mitsubishi Kasei) | 47 | parts by weight |
| Vinyl chloride/unsaturated dibasic acid copolymer | 44.8 | parts by weight |
| Methylethyl ketone | 80 | parts by weight |
| Toluene | 820 | parts by weight |

A mixture comprising the above components was agitated for 1.0 hour by an attritor to form a homegeneous dispersion. The dispersion was spray-dried by a spray drier (hot air temperature being 150° C.) to obtain a developer having an average particle size of about 5 to about 30 microns.

An electrostatic image formed according to the customary electrophotographic process was developed with the so prepared developer particles, and the toner image was transferred onto a transfer sheet and fixed under compression by a pressure fixing roller. No contamination of the fixing roller was observed, and clear copied images free of the offset phenomenon were obtained. Even if the copying operation was continued, good results are similarly obtained.

EXAMPLE 8

Two-component type developer composition:

| | | |
|---|---|---|
| Styrene-olefin copolymer (Klyrvel 90 manufactured by Velsicol Chemical) | 40 | parts by weight |
| Polyvinyl butyral resin (Slec BL-1 manufactured by Sekisui Kagaku) | 60 | parts by weight |
| Oil-soluble dye (Nigrosine Base EX manufactured by Orient Chemical) | 2.5 | parts by weight |
| Carbon black (Carbon #30 manufactured by Mitsubishi Kasei) | 33.5 | parts by weight |
| Vinyl chloride/vinylidene chloride copolymer | 20 | parts by weight |
| Acetone | 60 | parts by weight |
| Toluene | 760 | parts by weight |

A mixture comprising the above components was treated to form a developer and the copying operation was carried out in the same manner as described in Example 7. The contamination of the fixing roller with the developer and occurrence of the offset phenomenon were examined. Obtained results were the same as those obtained in Example 7.

EXAMPLE 9

Two-component type developer composition:

| | | |
|---|---|---|
| Vinyltoluene/acrylate/butadiene terpolymer (Pliolite OMS manufactured by Goodyear) | 65 | parts by weight |
| Polyisobutylene resin (Vistanix MML-8O manufacured by Petrochemical Co.) | 35 | parts by weight |
| Oil-soluble dye (Migrosine Base EX manufactured by Orient Chemical) | 3.0 | parts by weight |
| Carbon black (Carbon Black MA 100 manufactured by Mitsubishi Kasei) | 8.0 | parts by weight |
| Vinylidene chloride resin (Kureharon manufactured by Kureha Chemical) | 40 | parts by weight |

A mixture comprising the above components was kneaded at 150° C. in a hot roll mill and the kneaded mixture was cooled to room temperature (10° to 20° C.) to solidify the mixture. Then, the mixture was pulverized by a jet mill pulverizer to obtain a developer having an average particle size of 5 to 30 microns. An electrostatic image was formed according to the customary electrophotographic process, and the electrostatic image was developed by the so formed developer. The developer image was then transferred onto a transfer sheet, and the developer image was fixed by a pressure fixing roller. No contamination of the fixing roller with the developer was observed, and clear images free of the offset phenomenon were obtained.

EXAMPLE 10

Two-component type developer composition:

| | | |
|---|---|---|
| Styrene resin (Escorez 5820 manufactured by Esso Chemical) | 70 | parts by weight |
| Polyamide resin (Versamid 940 manufactured by Daiichi General Co.) | 10 | parts by weight |
| Vinyl toluene/butadiene copolymer (Pliolite VT-L manufactured by Goodyear) | 20 | parts by weight |
| Oil-soluble dye (Smisol Black AR manufactured by Sumitomo Chemical) | 2.0 | parts by weight |
| Carbon black (Carbon #30 manufactured by Mitsubishi Kasei) | 5.0 | parts by weight |
| Vinyl chloride/vinyl acetate/unsaturated dibasic acid copolymer (Hostaflex M-131 manufactured by Hoechst AG.) | 20 | parts by weight |

A mixture comprising the above components was kneaded at 160° C. by a heating kneader to form a homogeneous dispersion. The dispersion was cooled to room temperature (10° to 20° C.) to solidify the dispersion. The resulting solid was finely pulverized by a jet mill pulverizer to obtain a developer having an average particle size of about 5 to about 30 microns.

An electrostatic image obtained according to the customary electrophotographic process was developed with the so obtained developer, and the developer image was transferred onto a transfer sheet and the transferred developer image was fixed by a pressure fixing roller. No contamination of the fixing roller with the developer was observed and clear images free of the offset phenomenon were obtained. Even if the operation was conducted continuously, good results were similarly obtained.

EXAMPLE 11

One-component type developer composition:

| | | |
|---|---|---|
| Styrene resin (Piccolastic D-125 manufactured by Esso Chemical) | 85 | parts by weight |
| Vinyl chloride resin (Geon 103ZX manufactured by Japanese Geon) | 15 | parts by weight |
| Triiron tetroxide (Tetsuguro B8 manufactured by Toyo Shikiso) | 150 | parts by weight |
| Carbon black (Colax B manufactured by Degussa Co.) | 10 | parts by weight |

A mixture comprising the above components was kneaded at 150° C. by a hot roll mill to form a homogeneous composition. The composition was cooled to room temperature (10° to 20° C.) and pulverized by a pin mill type pulverizer to form developer particles having a size of 5 to 50 microns. By using the so obtained developer particles, the copying operation was carried out in a copying machine Electronic Copystar Model 700D manufactured by Mita Industrial Co. (a Teflon-coated heat fixing roller being installed). No contamination of the fixing roller was observed and clear copies free of the offset phenomenon were obtained. Even if the copying operation was continuously repeated to obtain 1000 prints, no contamination of the fixing roller was observed, and clear prints free of the offset phenomenon were obtained.

EXAMPLE 12

One-component type developer composition:

| | | |
|---|---|---|
| Styrene-acrylate copolymer (Pliolite ACL manufactured by Goodyear) | 60 | parts by weight |
| Rosin-modified maleic acid resin (Teskid MRG-H manufactured by Tokushima Seiyu) | 25 | parts by weight |
| Chloroprene rubber (Denka Chloroprene manufactured by Denki Kagaku) | 15 | parts by weight |
| Triiron tetroxide (Mapico BL-100 manufactured by Titan Kogyo) | 180 | parts by weight |
| Carbon black (Denka Black manufactured by Denki Kagaku) | 10 | parts by weight |
| Oil-soluble dye (Oil Black HBB manufactured by Orient Chemical) | 3 | parts by weight |

A mixture comprising the above components was kneaded at 160° C. by a heating kneader to form a homogeneous composition. The composition was cooled to room temperature (10° to 20° C.) and pulverized by a pin mill type pulverizer to form developer particles having a particle size of 5 to 50 microns. By using the obtained developer particles, the copying operation was carried out in copying machine Electronic Copystar Model 700D manufactured by Mita Industrial Co. (equipped with a Teflon-coated fixing roller). No contamination of the heat fixing roller with the developer was observed and clear copies free of the offset phenomenon were obtained.

EXAMPLE 13

One-component type developer composition:

| | | |
|---|---|---|
| Styrene resin (Amoco Resin 180240 manufactured by Amoco Co.) | 90 | parts by weight |
| Polyethylene glycol | 5 | parts by weight |
| Vinyl chloride/vinyl acetate/unsaturated basic acid copolymer (Hostaflex manufactured by Hoechst AG.) | 5 | parts by weight |
| Triiron tetroxide (Mapico BL-500 manufactured by Titan Kogyo) | 200 | parts by weight |
| Carbon black (Special Black IV manufactured by Degussa Co.) | 15 | parts by weight |
| Toluene | 600 | parts by weight |
| Methylethyl ketone | 60 | parts by weight |

A mixture comprising the above components was agitated by an attritor to form a homogeneous solution. The dispersion was spray-dried by a spray drier (hot air temperature being 150° C.) and then classified to obtain developer particles having a particle size of 5 to 30 microns. By using the so formed toner particles, an electrostatic image formed by the customary electrophotographic process was developed, and the developer image was transferred on a transfer sheet and fixed by a heat fixing roller coated with Teflon. No contamination of the heat fixing roller with the developer was observed and clear copies free of the offset phenomenon were obtained.

EXAMPLE 14

One-component type developer composition:

| | | |
|---|---|---|
| Styrene resin (Escorez manufactured by Esso Chemical) | 40 | parts by weight |
| Epoxy resin (Epikate 1004 manufactured by Shell Chemical) | 15 | parts by weight |
| Polyvinyl butyral resin (Slec BL-1 manufactured by Sekisui Kagaku) | 20 | parts by weight |
| Vinyl chloride-vinyl acetate copolymer (Slec C manufactured by Sekisui Kagaku) | 25 | parts by weight |
| Triiron tetroxide (Tetsuguro B6 manufactured by Toyo Shikiso) | 170 | parts by weight |
| Carbon black (Carbon #30 manufactured by Mitsubishi Kasei) | 15 | parts by weight |
| Toluene | 500 | parts by weight |
| Methylethyl ketone | 40 | parts by weight |

Developer particles were prepared from a mixture comprising the above components in the same manner as described in Example 13, and by using the so prepared developer particles, the copying operation was carried out in Copystar 700D (equipped with a heat fixing roller coated with a silicone rubber). The contamination of the heat fixing roller and occurrence of the offset phenomenon were examined. Obtained results were the same as those obtained in Example 13.

EXAMPLE 15

One-component developer composition:

| | | |
|---|---|---|
| Styrene olefin copolymer (Klyrvel 90 manufactured by Velsicol | 70 | parts by weight |

-continued

| | | |
|---|---|---|
| Chemical) | | |
| Polyester resin (Vylon 300 manufactured by Toyobo) | 23 | parts by weight |
| Vinylidene chloride resin (Kureharon manufactured by Kureha Chemical) | 7 | parts by weight |
| Triiron tetroxide (Mapico Bl-500 manufactured by Titan Kogyo) | 85 | parts by weight |
| Carbon black (Colax L manufactured by Degussa Co.) | 10 | parts by weight |
| Oil-soluble dye (Oil Black HBB manufactured by Orient Chemical) | 4 | parts by weight |
| Methylethyl ketone | 50 | parts by weight |
| Toluene | 650 | parts by weight |

A mixture comprising the above components was treated in the same manner as described in Example 13 to obtain developer particles having a size of 5 to 30μ. In 100 parts by weight of the developer was 0.1 part by weight of carbon black was blended to cover the surfaces of the developer particles with carbon black. By using the so prepared developer particles, the copying operation was carried out in a copying machine Electronic Copystar Model 700D (installed with a pressure fixing roller coated with Teflon). No contamination of the fixing roller was observed and clear copies free of the offset phenomenon were obtained.

EXAMPLE 16

One-component type developer composition:

| | | |
|---|---|---|
| Styrene resin (Piccolastic E-125 manufactured by Esso Chemical) | 80 | parts by weight |
| Terpene-phenol copolymer (YS Polyester manufactured by Yasuhara Yushi) | 25 | parts by weight |
| Vinyl chloride/vinyl acetate copolymer (Geon 400X150P manufactured by Japanese Geon) | 45 | parts by weight |
| Triiron tetroxide (Dowa Black N-805 manufactured by Dowa Teppun) | 160 | parts by weight |
| Carbon black (Carbon #44 manufactured by Mitsubishi Kasei) | 12 | parts by weight |
| Toluene | 550 | parts by weight |
| Methylethyl ketone | 60 | parts by weight |

In the same manner as described in Example 13, developer particles having a size of 5 to 50μ were prepared from a mixture comprising the above components. An electrostatic image formed according to the customary electrophotographic process was developed with the so prepared developer particles, and the developer was transferred onto a transfer sheet and fixed by using a heat fixing roller coated with a metal. No contamination of the fixing roller was observed, and clear copied images free of the offset phenomenon were obtained.

EXAMPLE 17

One-component type developer composition:

| | | |
|---|---|---|
| Styrene/olefin copolymer (Klyrvel 90 manufactured by Velsicol Chemical) | 45 | parts by weight |
| Styrene/acrylate copolymer | 25 | parts by weight |

-continued

| | | |
|---|---|---|
| (Pliolite AC manufactured by Goodyear) | | |
| Chloroprene rubber (Denca Chloroprene manufactured by Denki Kagaku) | 30 | parts by weight |
| Triiron tetroxide (Mapico BL-500 manufactured by Titan Kogyo) | 150 | parts by weight |
| Carbon black (Super Powder manufactured by Morishita Sangyo) | 13 | parts by weight |
| Toluene | 480 | parts by weight |
| Methylethyl ketone | 40 | parts by weight |

In the same manner as described in Example 13, a developer having a particle size of 5 to 50μ was prepared from the above components. An electrostatic image was formed according to the customary electrophotographic process and developed by the so obtained developer. The developer image was transferred on a transfer paper and the transferred developer image was fixed by a metal-coated pressure fixing roller. No contamination of the surface of the pressure fixing roller was observed and clear copied images free of the offset phenomenon were obtained.

EXAMPLE 18

One-component type developer composition:

| | | |
|---|---|---|
| Epoxy resin (Epikoto 1004 manufactured by Shell Chemical) | 40 | parts by weight |
| Polyisobutylene (Vistanex MML-80 manufactured by Petrochemical) | 20 | parts by weight |
| Acrylic resin (Paraloid B-67 manufactured by Rohm & Haas) | 25 | parts by weight |
| Vinyl chloride/vinyl acetate/unsaturated maleic acid copolymer (Slec M manufactured by Sekisui Kagaku) | 15 | parts by weight |
| Triiron tetroxide (Tetsuguro B6 manufactured by Toyo Shikiso) | 180 | parts by weight |
| Carbon black (Mogul L manufactured by Cabot Corporation) | 5 | parts by weight |
| Aluminum fine powder | 12 | parts by weight |

A mixture comprising the above components was kneaded at 160° C. by a heating kneader to form a homogeneous composition. The composition was cooled to room temperature (10° to 20° C.) and pulverized by a pin mill type pulverizer to form developer particles having a size of 5 to 50 microns. An electrostatic image formed by the customary electrophotographic process was developed with the so formed developer, and the developer image was transferred onto a transfer sheet and fixed by a pressure fixing roller. No contamination of the fixing roller with the developer was observed and clear images free of the offset phenomenon were obtained.

EXAMPLE 19

One-component type developer composition:

| | | |
|---|---|---|
| Styrene/butadiene copolymer (Pliolite S-5B manufactured by Goodyear) | 40 | parts by weight |
| Phenolic resin (Tamanol 1110R manufactured by Arakawa Rinsan) | 40 | parts by weight |
| Vinyl chloride/vinyl acetate/ | 20 | parts by weight |

-continued

| | | |
|---|---|---|
| vinyl alcohol (Slec A manufactured by Sekisui Kagaku) | | |
| Triiron tetroxide (Tetsuguro B6 manufactured by Toyo Shikiso) | 180 | parts by weight |
| Carbon black (Elftex 8 manufactured by Cabot Corp.) | 5 | parts by weight |
| Oil-soluble dye (Spilon Black GMH manufactured by Hodogaya Chemical) | 8 | parts by weight |

A mixture comprising the above components was kneaded at 160° C. in a heating kneader to form a homogeneous composition. The composition was cooled to room temperature (10° to 20° C.) to solidify the composition. The solidified composition was pulverized by a pin mill pulverizer to form a developer having a particle size of 5 to 50μ. An electrostatic image was formed according to the customary electrophotographic process and was developed by the so formed developer. The developer image was transferred on a transfer paper and fixed by a pressure fixing roller. No contamination of the surface of the pressure fixing roller was observed, and clear copied images free of the offset phenomenon were obtained.

EXAMPLE 20

Two-component type developer composition:

| | | |
|---|---|---|
| Acrylic resin (Paraloid B-67 manufactured by Rhom & Haas) | 25 | parts by weight |
| Vinyl toluene/butadiene copolymer (Pliolite VT manufactured by Goodyear) | 75 | parts by weight |
| Oil-soluble dye (Nigrosine Base EX manufactured by Orient Chemical) | 2.2 | parts by weight |
| Carbon black (Printex 140 manufactured by Degussa Co.) | 7.7 | parts by weight |
| Acrylonitrile/butadiene rubber (Chemigum N-612A manufactured by Goodyear) | 15 | parts by weight |

A mixture comprising the above components was homogeneously kneaded at 150°±5° C. for about 25 minutes in a hot roll mill, and the mixture was cooled to room temperature to solidify the mixture. Then, the solidified mixture was roughly pulverized by a feather mill pulverizer, then finely pulverized by an ultrasonic jet mill pulverizer (Jet Mill Model I manufactured by Nippon Pneumatic Co.) and classified by an air classifier to obtain a developer having an average particle size of about 5 to about 30μ. The copying operation was carried out by using the so obtained developer in a copying machine Electronic Copystar Model 251R manufactured by Mita Industrial Co. (installed with a heat-fixing roller coated with Teflon). No contamination was observed on the surface of the heat-fixing roller and clear images free of the offset phenomenon were obtained. Even if the foregoing operation was repeated to obtain 1000 prints, no contamination was observed on the surface of the fixing roller and clear prints free of the offset phenomenon were obtained.

EXAMPLE 21

Two-component type developer composition:

| | | |
|---|---|---|
| Styrene resin (Piccolastic D-150 manufactured by Esso Chemical) | 85 | parts by weight |

-continued

| | | |
|---|---|---|
| Polyisobutylene resin (Vistadex manufactured by Petrochemical) | 15 | parts by weight |
| Oil-soluble dye (Oil Black HBB manufactured by Orient Chemical) | 2 | parts by weight |
| Carbon black (Special Black IV manufactured by Degussa Co.) | 6 | parts by weight |
| Acrylonitrile/butadiene rubber (Chemigum N-300 manufactured by Goodyear) | 10 | parts by weight |

A mixture comprising the above components was treated and the copying operation was carried out in the same manner as described in Example 20 by using Copystar 251R, and the contamination of the fixing roller with the developer and occurrence of the offset phenomenon were examined. Obtained results were the same as those obtained in Example 20.

EXAMPLE 22

Two-component type developer composition:

| | | |
|---|---|---|
| Saturated Polyester resin (Ester Resin 20 manufactured by Toyobo) | 36 | parts by weight |
| Styrene-acrylate copolymer (Pliolite AC manufactured by Goodyear) | 84 | parts by weight |
| Oil-soluble dye (Nigrosine Base EX manufactured by Orient Chemical) | 3.0 | parts by weight |
| Carbon black (Carbon #30 manufactured by Mitsubishi Kasei) | 10.35 | parts by weight |
| Acrylonitrile/butadiene/styrene terpolymer | 18 | parts by weight |

A mixture comprising the above components was treated and the copying operation was carried out in the same manner as in Example 20 by using Copystar 251R. The contamination of the fixing roller with the developer and occurrence of the offset phenomenon were examined. Obtained results were the same as those obtained in Example 20.

EXAMPLE 23

Two-component type developer composition:

| | | |
|---|---|---|
| Vinyl toluene/acrylate/butadiene copolymer (Pliolite OMS manufactured by Goodyear) | 97.5 | parts by weight |
| Polyvinyl butyral resin (Slec BM-S manufactured by Sekisui Kagaku) | 52.5 | parts by weight |
| Oil-soluble dye (Oil Black BW manufactured by Orient Chemical) | 3.8 | parts by weight |
| Carbon black (Special Black IV manufactured by Degussa Co.) | 12.2 | parts by weight |
| Styrene/acrylonitrile copolymer | 30 | parts by weight |

A mixture comprising the above components was kneaded at 160°±5° C. for about 30 minutes by a heating kneader to form a homogeneous dispersion. The dispersion was cooled to room temperature to solidify the dispersion. The resulting solid was finely pulverized and classified in the same manner as in Example 20 to obtain a developer having an average particle size of about 5 to about 30 microns.

The copying operation was carried out by using the so prepared developer in the same manner as described in Example 20. The contamination of the fixing roller with the developer and occurrence of the offset phenomenon were examined. Obtained results were the same as those obtained in Example 20.

EXAMPLE 24

Two-component type developer composition:

| | | |
|---|---|---|
| Styrene resin (Piccolastic D-150 manufactured by Esso Chemical) | 91 | parts by weight |
| Polyvinyl butyral resin (Slec BM-S manufactured by Sekisui Kagaku) | 39 | parts by weight |
| Oil-soluble dye (Nigrosine Base EX manufactured by Orient Chemical) | 3.25 | parts by weight |
| Carbon black (MA-100 manufactured by Mitsubishi Kasei) | 40.6 | parts by weight |
| Acrylonitrile/butadiene rubber (Chemigum N-206 manufactured by Goodyear) | 32.5 | parts by weight |
| Toluene | 395 | parts by weight |
| Methylethyl ketone | 50 | parts by weight |

A mixture having the above components was stirred in a ball mill for 24 hours to form a homogeneous dispersion. The dispersion was spray-granulated in a spray-drying device including spray nozzles 1.2 mm in diameter at a hot air temperature of 150°±3° C. under a spraying pressure of 3 Kg/cm$^2$. The obtained particles were classified by an air classifier to obtain a developer having a particle size of 5 to 30μ. By using the so obtained developer, the copying operation was carried out in the same manner as described in Example 20. Good results were similarly obtained as in Example 20.

EXAMPLE 25

Two-component type developer composition:

| | | |
|---|---|---|
| Styrene/acrylate copolymer (Pliolite AC manufactured by Goodyear) | 60 | parts by weight |
| Styrene resin (Piccolastic D-125 manufactured by Esso Chemical) | 40 | parts by weight |
| Oil-soluble dye (Oil Black HBB manufactured by Orient Chemical) | 3 | parts by weight |
| Carbon Black (Special Black IV manufactured by Degussa Co.) | 6 | parts by weight |
| Acrylonitrile/butadiene copolymer (NIppol 1042 manufactured by Japanese Geon) | 30 | parts by weight |
| Toluene | 300 | parts by weight |
| Methylethyl ketone | 45 | parts by weight |

A mixture having the above components was stirred for 25 minutes by a KVM dispersing machine (manufactured by Toyama Tekkosha) to form a homogeneous dispersion. In the same manner as described in Example 24, the dispersion was spray-granulated and air-classified to obtain a developer having a particle size of 5 to 30μ. By using the so obtained developer, the copying operation was carried out in the same manner as in Example 20. Good results were similarly obtained as in Example 20.

EXAMPLE 26

Two-component type developer Composition:

| | | |
|---|---|---|
| Styrene resin (Amoco Resin 18-240 manufactured by Amoco Co.) | 30 | parts by weight |
| Styrene-butadiene copolymer (Pliolite VT-L manufactured by Goodyear) | 35 | parts by weight |
| Fatty acid amide (Diamid Y manufactured by Nippon Kasei) | 35 | parts by weight |
| Oil-soluble dye (Oil Black HBB manufactured by Orient Chemical) | 3 | parts by weight |
| Carbon black (Carbon #30 manufactured by Mitsubishi Kasei) | 6 | parts by weight |
| Acrylonitrile/butadiene/ethylene copolymer resin | 30 | parts by weight |
| Toluene | 650 | parts by weight |
| Methylethyl ketone | 50 | parts by weight |

A mixture having the above components was stirred for 25 minutes by a dissolver dispersing machine to form a homogeneous dispersion. In the same manner as described in Example 24, the dispersion was spray-granulated and air-classified to obtain a developer having a particle size of 5 to 30μ. The developer was charged in a developer bottle of a copying tester manufactured by Mite Industrial Co. and the copying operation was carried out through an original. Clear copies having well-fixed images free of the offset phenomenon were obtained. Even if the foregoing operation was continuously repeated to obtain 100 prints, no contamination was observed on the fixing roller, and clear prints free of the offset phenomenon as good as the first print were obtained.

EXAMPLE 27

Two-component type developer composition:

| | | |
|---|---|---|
| Polyamide resin (Versamid 940 manufactured by Daiichi General) | 100 | parts by weight |
| Polyisobutylene resin (Vistanex MML-80 manufactured by Petrochemical) | 20 | parts by weight |
| Oil-soluble dye (Nigrosine Base EX manufactured by Orient Chemical) | 1.8 | parts by weight |
| Carbon black (MA-100 manufactured by Sumitomo Kasei) | 7.2 | parts by weight |
| Acrylonitrile/butadiene rubber (Highmer 1051 manufactured by Japanese Geon) | 20 | parts by weight |

A mixture comprising the above components was treated to obtain a developer having a size of 5 to 30μ and the copying operation was carried out in the same manner as described in Example 26. The contamination of the pressure fixing roller with the developer and occurrence of the offset phenomenon were examined. Obtained results were the same as those obtained in Example 26.

EXAMPLE 28

One-component type developer composition:

| | | |
|---|---|---|
| Styrene resin (Piccolastic D-150 manufactured by Esso Chemical) | 100 | parts by weight |
| Fatty acid amide (Diamid Y manufactured by Nippon Kasei) | 10 | parts by weight |
| Acrylonitrile/butadiene copolymer (Chemigum N-608 manufactured by Goodyear) | 35 | parts by weight |
| Triiron tetroxide (Tetsuguro B6 manufactured by Toyo Shikiso) | 150 | parts by weight |

-continued

| | | |
|---|---|---|
| Carbon black (Colax B manufactured by Degussa Co.) | 12 | parts by weight |

A mixture comprising the above components was kneaded at 150°±5° C. by a hot three-roll mill to form a homogeneous composition. The composition was cooled to room temperature, roughly pulverized by a feather mill and finely pulverized by a pin mill type pulverizer (ACM manufactured by Hosokawa Tekkosho), followed by air classification, to form developer particles having a particle size of 10 to 30 microns. By using the obtained developer particles, the copying operation was carried out in copying machine Electronic Copystar Model 700D (equipped with a Teflon-coated heat fixing roller) manufactured by Mita Industrial Co. No contamination of the heat fixing roller with the developer was observed and clear copies free of the offset phenomenon were obtained. Even if the operation was continuously repeated to obtain 1000 prints, no contamination of the fixing roller was observed and clear prints free of the offset phenomenon were obtained.

EXAMPLE 29

One-component type developer composition:

| | | |
|---|---|---|
| Styrene/acrylate copolymer (Pliolite ACL manufactured by Goodyear) | 70 | parts by weight |
| Fatty acid amide (Amaid AP-1 manufactured by Nippon Kasei) | 10 | parts by weight |
| Rosin-modified maleic acid resin (Taskid MRG-H manufactured by Tokushima Seiyu) | 20 | parts by weight |
| Acrylonitrile/butadiene copolymer (Chemigum N-625-B manufactured by Goodyear) | 25 | parts by weight |
| Triiron tetroxide (Mapico BL-100 manufactured by Titan Kogyo) | 120 | parts by weight |
| Carbon black (Denka Black manufactured by Denki Kagaku) | 10 | parts by weight |
| Oil-soluble dye (Oil black HBB manufactured by Orient Chemical) | 2 | parts by weight |

Developer particles were prepared from a mixture comprising the above components by kneading at 160°±3° C. for 25 minutes and conducting pulverization and classification in the same manner as described in Example 28, and by using the so prepared developer particles, the copying operation was carried out. The contamination of the heat fixing roller and occurrence of the offset phenomenon were examined. Obtained results were the same as those obtained in Example 28.

EXAMPLE 30

One-component developer composition:

| | | |
|---|---|---|
| Styrene resin (Amoco Resin 18-240 manufactured by Amoco Co.) | 100 | parts by weight |
| Polyethylene glycol | 10 | parts by weight |
| Triiron tetroxide (Tetsuguro B6 manufactured by Toyo Shikiso) | 180 | parts by weight |
| Carbon black (Special Black IV manufactured by Dagussa Co.) | 12 | parts by weight |
| Acrylonitrile/butadiene rubber (Nippol HF-101 manufactured by Japanese Geon) | 30 | parts by weight |
| Toluene | 650 | parts by weight |

-continued

| | | |
|---|---|---|
| Methylethyl ketone | 65 | parts by weight |

A mixture having the above components was stirred in a disperse mill for 25 minutes to form a homogeneous dispersion. The dispersion was spray-granulated in a spray-drying device including spray nozzles 1.6 mm in diameter at a hot air temperature of 150°±3° C. under a spraying pressure of 1.5 Kg/cm$^2$. The obtained particles were classified by an air classifier to obtain a developer having a particle size of 10 to 30μ.

An electrostatic image formed by the customary electrophotographic process was developed with the so formed developer, and the developer image was transferred onto a transfer sheet and fixed by a pressure fixing roller coated with Teflon. No contamination of the fixing roller was observed. Clear copies free of the offset phenomenon were obtained.

EXAMPLE 31

One-component type developer composition:

| | | |
|---|---|---|
| Styrene resin (Piccolastic D-150 manufactured by Esso Chemical) | 25 | parts by weight |
| Epoxy resin (Epikote 1004 manufactured by Shell Chemical) | 55 | parts by weight |
| Polyvinyl butyral (Slec BL-1 manufactured by Sekisui Kagaku) | 20 | parts by weight |
| Triiron tetroxide (Tetsuguro B6 manufactured by Toyo Shikiso) | 250 | parts by weight |
| Carbon black (Carbon #30 manufactured by Mitsubishi Kasei) | 13 | parts by weight |
| Acrylonitrile/butadiene copolymer (Nippol DN-401 manufactured by Japanese Geon) | 25 | parts by weight |
| Toluene | 700 | parts by weight |
| Methylethyl ketone | 60 | parts by weight |

A mixture comprising the above components was dispersed, pulverized and classified in the same manner as described in Example 30 to obtain developer particles having a size of 10 to 30μ. By using the so prepared developer particles, the copying operation was carried out in a copying machine Electronic Copystar Model 700D (installed with a heat fixing roller coated with a silicone rubber). No contamination of the fixing roller was observed and clear copies free of the offset phenomenon were obtained. Even if the operation was continuously repeated to obtain 1000 prints, no contamination of the fixing roller was observed and clear prints free of the offset phenomenon were obtained.

EXAMPLE 32

Carbon black (Colax L manufactured by Degussa Co.) was uniformly blended in an amount of 0.1% by weight into the developer obtained in Example 32, and by using the so obtained developer, the copying operation was carried out in a copying machine Electronic Copystar 700D manufactured by Mita Industrial Co. (equipped with a heat fixing roller coated with Teflon). Clear copies similar to those obtained in Example 31 were obtained.

EXAMPLE 33

By using the developer obtained in Example 32, the copying operation was carried out in a copying machine Electronic Copystar 900D (equipped with a metal-coated, pressure fixing roller). Clear copies similar to those obtained in Example 31 were obtained.

EXAMPLE 34

One-component type developer composition:

| | | |
|---|---|---|
| Styrene resin (Arcon P-125 manufactured by Arakawa Rinsan) | 30 | parts by weight |
| Epoxy resin (Epiclon 4050 manufactured by Dainippon Ink) | 25 | parts by weight |
| Fatty acid amide (Lubron O manufactured by Nippon Kasei) | 45 | parts by weight |
| Triiron tetroxide (Tetsuguro B6 manufactured by Toyo Shikiso) | 280 | parts by weight |
| Carbon black (Carbon #30 manufactured by Mitsubishi Kasei) | 12 | parts by weight |
| Acrylonitrile/butadiene copolymer (Chemigum N-100 manufactured by Goodyear) | 40 | parts by weight |
| Toluene | 800 | parts by weight |
| Methylethyl ketone | 70 | parts by weight |

A mixture comprising the above components was dispersed and spray-granulated in the same manner as described in Example 15, and air-classified to form developer particles having a size of 5 to 15μ.

An electrostatic image was formed according to the customary electrophotographic process, and the electrostatic image was developed by the so formed developer. The developer image was then transferred onto a transfer sheet, and the developer image was fixed by a metal-coated pressure fixing roller. No contamination of the fixing roller with the developer was observed, and clear images free of the offset phenomenon were obtained.

EXAMPLE 35

One-component type developer composition:

| | | |
|---|---|---|
| Epoxy resin (Epikote 1004 manufactured by Shell Chemical) | 40 | parts by weight |
| Polyisobutyrene (Vistanex MML-80 manufactured by Petrochemical) | 20 | parts by weight |
| Acrylic resin (Paraloid B067 manufactured by Rohm & Haas) | 25 | parts by weight |
| Acrylonitrile/butadiene copolymer (Chemigum N-612A manufactured by Goodyear) | 35 | parts by weight |
| Triiron tetroxide (Tetsuguro B6 manufactured by Toyo Shikiso) | 180 | parts by weight |
| Carbon black (Mogul L manufactured by Cabot Corporation) | 5 | parts by weight |
| Aluminum fine powder | 12 | parts by weight |

A mixture comprising the above components was kneaded at 150° C. by a heating roll to form a homogeneous composition. The composition was cooled to room temperature (10° to 20° C.) to solidify the dispersion. The solid was pulverized by a pin mill pulverizer to obtain a developer having an average particle size of 5 to 50 microns. By using the so formed developer particles, the copying operation was carried out in a copying machine Electronic Copystar Model 900D manufactured by Mita Industrial Co. through an original. No contamination of the pressure fixing roller with the developer was observed and clear copies free of the offset phenomenon were obtained.

EXAMPLE 36

One-component type developer composition:

| | | |
|---|---|---|
| Styrene/butadiene copolymer (Pliolite S-5B manufactured by Goodyear) | 40 | parts by weight |
| Phenolic resin (Tamenol 1110R manufactured by Arakawa Rinsan) | 40 | parts by weight |
| Acrylonitrile/butadiene/styrene copolymer | 20 | parts by weight |
| Triiron tetroxide (Tetsuguro B6 manufactured by Toyo Shikiso) | 180 | parts by weight |
| Carbon black (Elftex 8 manufactured by Cabot) | 5 | parts by weight |
| Oil-soluble dye (Spilon Black GMH manufactured by Hodogaya Chemical) | 3 | parts by weight |

A mixture having the above components was kneaded at 160° C. by a heating kneader to form a homogeneous composition. The composition was cooled to room temperature (10° to 20° C.) to solidify the composition. The composition was pulverized by a pin mill pulverizer to form a developer having a particle size of 5 to 50μ.

An electrostatic image formed according to customary electrophotographic process was developed with the so prepared developer particles, and the developer image was transferred onto a transfer sheet and fixed by using a pressure fixing roller. No contamination of the fixing roller with the developer was observed, and clear copied images free of the offset phenomenon were obtained.

What we claim is:

1. In an electrostatic photographic process which comprises providing an electrostatic image on a photosensitive plate for electrostatic photography, developing the electrostatic image with a powder developer to form a powder image, transferring the powder image onto a transfer sheet and fixing the powder image on the transfer sheet, the improvement which comprises causing the transfer sheet bearing the powder image to fall in contact with a surface of a fixing roller under application of heat or pressure, said powder developer comprising a binder medium and a pigment dispersed therein, said binder medium comprising (A) a thermoplastic or rubbery polymer containing a member selected from the group consisting of a halogen atom and a nitrile group at a concentration of at least 100 milliequivalents per 100 g of the polymer and (B) a binder having a melting temperature lower than that of the polymer (A) at an (A)/(B) mixing weight ratio of from 1/20 to 1/1, the halogen- or nitrile-containing polymer (A) being present in the form of fine particles dispersed in the continuous phase of the binder (B).

2. A process according to claim 1 wherein the polymer (A) is a chlorine-containing polymer containing a chlorine atom at a concentration of 200 to 4000 milligram atoms per 100 g of the polymer.

3. A process according to claim 1 wherein the polymer (A) is a homopolymer or copolymer of vinyl chloride.

4. A process according to claim 1 wherein the polymer (A) is a vinyl chloride/vinyl acetate copolymer or vinyl chloride/vinyl acetate/ethylenically unsaturated carboxylic acid copolymer containing a chlorine atom at a concentration of 500 to 1100 milligram atoms per 100 g of the polymer.

5. A process according to claim 1 wherein the binder (B) is a vinyl aromatic resin.

6. A process according to claim 1 wherein the polymer (A) is a copolymer of an ethylenically unsaturated nitrile containing a nitrile group at a concentration of 200 to 1600 millimoles per 100 g of the polymer.

7. A process according to claim 1 wherein the polymer (A) is a copolymer of (a) an ethylenically unsaturated nitrile with (b) at least one monomer selected from the group consisting of diolefin monomers, mono-olefin monomers, vinyl aromatic monomers, acrylic monomers, vinyl ester monomers and vinyl ether monomers.

8. A process according to claim 1 wherein the polymer (A) is an acrylonitrile/butadiene copolymer, acrylonitrile/styrene copolymer, acrylonitrile/butadiene/styrene copolymer acrylonitrile/butadiene/styrene/acrylic acid copolymer or acrylonitrile/butadiene/styrene/methacrylic acid copolymer.

9. A process according to claim 1 wherein the polymer (A) is present in the form of particles having a size smaller than 0.5$\mu$, dispersed in the continuous phase of the binder (B).

10. A process according to claim 1 wherein the binder (B) is an acrylic resin.

11. A process according to claim 1 wherein the melting temperature of the binder (B) is higher than the softening point of the polymer (A).

12. A process according to claim 1 wherein the pigment is incorporated in an amount of 1 to 300% by weight based on the binder medium.

13. A process according to claim 1 wherein the developer is a one-component type developer and the pigment is a finely divided magnetic material, the finely divided magnetic material being present in an amount of 50 to 300% by weight based on the binder medium.

14. A process according to claim 1 wherein the developer is a two-component type developer and the pigment is a coloring pigment, the coloring pigment being present in an amount of 1 to 15% by weight based on the binder medium.

* * * * *